US006186759B1

(12) United States Patent
Hayano et al.

(10) Patent No.: US 6,186,759 B1
(45) Date of Patent: Feb. 13, 2001

(54) HELICAL BLADE TYPE COMPRESSOR AND A REFRIGERATION CYCLE APPARATUS USING THE SAME

(75) Inventors: Makoto Hayano, Yokohama; Hirotsugu Sakata, Chigasaki; Akira Morishima, Fujinomiya, all of (JP)

(73) Assignee: Kabushiki Kaisha Toshiba, Kawasaki (JP)

( * ) Notice: Under 35 U.S.C. 154(b), the term of this patent shall be extended for 0 days.

(21) Appl. No.: 09/262,320

(22) Filed: Mar. 4, 1999

(30) Foreign Application Priority Data

Mar. 11, 1998 (JP) ..... 10-059778

(51) Int. Cl.[7] ..... F01C 21/08
(52) U.S. Cl. ..... 418/220; 418/152
(58) Field of Search ..... 418/220, 152

(56) References Cited

U.S. PATENT DOCUMENTS

| | | | | |
|---|---|---|---|---|
| 4,706,971 | * | 11/1987 | Schirmer | 277/215 |
| 4,871,304 | * | 10/1989 | Iida et al. | 418/220 |
| 5,332,377 | * | 7/1994 | Hirayama et al. | 418/220 |
| 5,542,832 | * | 8/1996 | Sone et al. | 418/220 |
| 5,791,193 | * | 8/1998 | Uematsu et al. | 74/467 |

FOREIGN PATENT DOCUMENTS

| | | | | |
|---|---|---|---|---|
| 2611524 | * | 7/1984 | (DE) . | |
| 4220830 | * | 1/1993 | (DE) | 418/220 |
| 224862 | * | 12/1924 | (EP) | 418/220 |
| 3-145592 | * | 12/1924 | (JP) | 418/220 |
| 2-80863 | * | 3/1990 | (JP) | 418/220 |
| 2-201090 | * | 8/1990 | (JP) | 418/220 |
| 3-3993 | * | 1/1991 | (JP) | 418/220 |
| 3-145592 | * | 6/1991 | (JP) | 418/220 |
| 3-172595 | * | 6/1991 | (JP) | 418/220 |
| 5-272476 | * | 10/1993 | (JP) | 418/220 |

* cited by examiner

*Primary Examiner*—Thomas Denion
*Assistant Examiner*—Theresa Trieu
(74) *Attorney, Agent, or Firm*—Oblon, Spivak, McClelland, Maier & Neustadt, P.C.

(57) ABSTRACT

A helical blade type compressor comprising a case, a cylindrical cylinder provided in the case, a roller disposed in the cylinder, and helical blades of uneven pitches for dividing a compression chamber so that the volume may be gradually smaller in the axial direction between the cylinder and roller, by revolving the cylinder and roller to move the compression chamber in the volume decreasing direction, thereby compressing the air, wherein at least one seal member is provided in the roller for separating into pressure in the case and the pressure in the compression chamber.

31 Claims, 21 Drawing Sheets

FIG. 50A
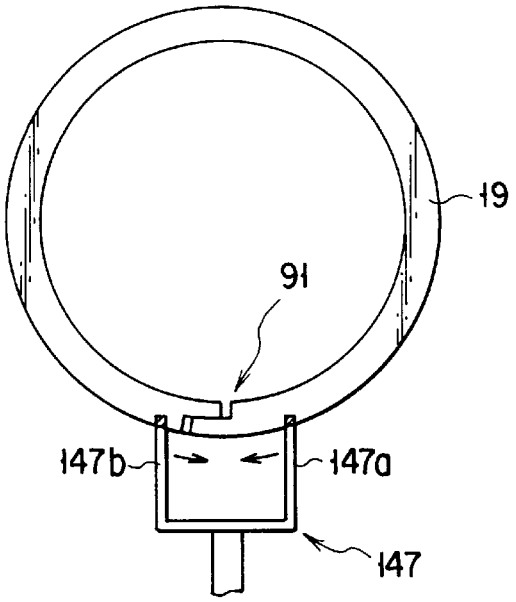
FIG. 50B
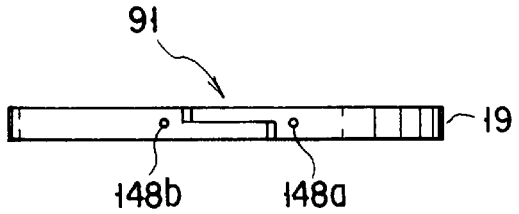
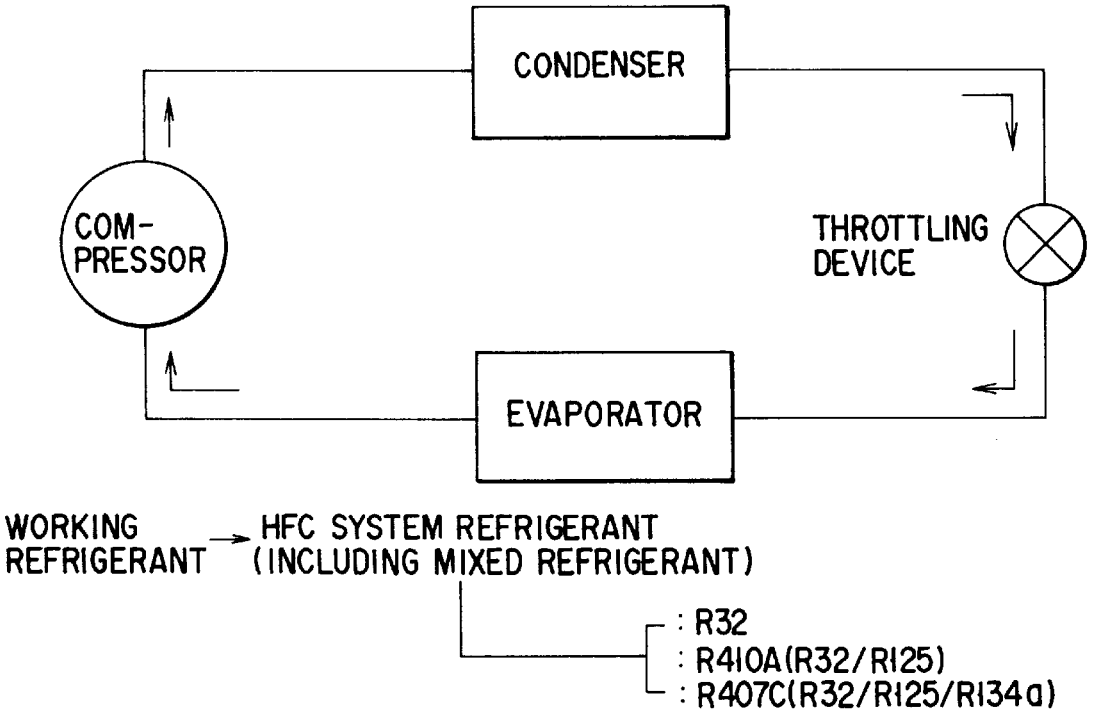
FIG. 51

HELICAL BLADE TYPE COMPRESSOR AND A REFRIGERATION CYCLE APPARATUS USING THE SAME

BACKGROUND OF THE INVENTION

The present invention relates to a helical blade type compressor used as a compressor for composing a refrigeration cycle of, for example, an air conditioner.

The helical blade type compressor has been recently proposed.

In this helical blade type compressor, a cylinder for composing the compression mechanism is disposed in an enclosed case, and a roller revolves in the cylinder. Spiral grooves are provided in the roller circumference or cylinder inside, and helical blades are contained to be free to move in and out.

In such constitution, plural combustion chambers are formed continuously between the cylinder and roller, and between mutual helical blades. When the roller revolves in this state, the refrigerant gas is sucked into the compression chamber at one end side, and is compressed as being gradually transferred to the compression chamber at other end side.

According to this kind of compressor, defective sealing performance in the conventional reciprocating type or rotary type compressor can be eliminated, and the sealing performance is enhanced in a relatively simple constitution, and efficient compression is realized, while it is easier to manufacture and assemble parts.

In this helical blade type compressor, sealing between the high pressure side and low pressure side is achieved by the sliding surface or tiny gap between the roller and the bearing member which receives the thrust load of the roller.

However, in the structure of sealing by making use of the thrust load of the roller, it is hard to keep a sufficient sealing performance, and the thrust sliding surface may be seized in case of occurrence of an excessive thrust load. In the conventional structure, since the thrust load acting on the roller cannot be controlled easily, there were problems to be solved in relation to performance and reliability.

BRIEF SUMMARY OF THE INVENTION

It is hence an object of the invention to present a helical blade type compressor capable of controlling the thrust load and obtaining a sufficient sealing performance.

To solve the problems, the invention discloses the following constitutions, effects and actions. The corresponding drawings are described below for reference, but it must be noted that they should not be interpreted to limit the scope of the invention.

(1) (corresponding to FIG. 1 and FIG. 5) A helical blade type compressor comprising:

a case, a cylindrical cylinder provided in the case, a roller disposed in the cylinder, and helical blades of uneven pitches for dividing a compression chamber so that the volume may be gradually smaller in the axial direction between the cylinder and roller, for revolving the cylinder and roller to move the compression chamber in the volume decreasing direction, thereby compressing the air, in which at least one seal member is provided in the roller for separating into pressure in the case and the pressure in the compression chamber.

According to such constitution, by disposing the seal member for separating high and low pressure in the cylinder, secure sealing is enabled without generating excessive thrust load, and the performance and reliability are enhanced. By the use of seal ring, it is easy to adjust the thrust load acting on the roller.

In this constitution, the expressing "provided in the roller" means not only direct holding by the roller, but also contacting with the roller as being held by a member confronting the roller, for example, the cylinder or at the receiving member side.

(2) (corresponding to FIG. 1 and FIG. 5) In the helical blade type compressor of (1), the seal member is freely inserted into an annular groove provided in the roller outer circumference, and abuts against the annular groove and cylinder to separate into the pressure in the case and the pressure in the compression chamber.

According to such constitution, it is easy to adjust the balance of the thrust load acting in the roller axial direction. Besides, the structure is simple, the manufacturing efficiency is excellent (processing cost is lowered, and the assembling performance is improved), so that an inexpensive compressor may be presented.

(3) (corresponding to FIG. 6, FIG. 7, and FIG. 8) In the helical blade type compressor of (2), the annular groove and the seal ring member to be inserted in the annular groove are provided in a plurality each. According to such constitution, when using plural seal ring members, by sharing and processing common seal rings, the cost is reduced.

Preferably, the plural annular rings and seal ring members should be of same dimensions and materials, individually.

Or, between the plural annular rings and seal ring members, the dimensions or materials may be different at least at one position.

By using plural seal ring members, it is very effective for keeping the sealing performance depending on the condition of temperature or pressure. In such a case, the shape, dimension or material should be selected depending on the condition of the position of the disposition of each seal ring member, so that the performance and reliability may be further enhanced.

(4) (corresponding to FIG. 6) In the helical blade type compressor of (2), the roller has a flange of a large diameter, and the seal ring is held by the flange.

By holding the seal ring by the flange, the bending moment is prevented from acting on the section of the seal ring. As a result, if the seal ring is thin and made of a soft material, that is, if the rigidity is weak, a large pressure difference can be sealed by the seal ring member. Hence, a compact and inexpensive seal structure can be presented.

(5) (corresponding to FIG. 7) In the helical blade type compressor of (2), the roller is composed of a main body and a lid which can be divided in the portion of the annular groove.

According to such constitution, the seal ring can be easily fitted in the annular groove.

In one aspect, a packing is placed between the roller main body and lid, and they are fixed by a bolt. In such constitution, the sealing performance of the divided portion is enhanced.

In other aspect, the roller main body and lid are made of same material, and the surface is treated by nitriding, Ni—P—B plating or other surface treatment depending on the material of the seal ring member. In such constitution, the coefficient of thermal expansion of the main body and lid is the same, and therefore if temperature rise occurs during operation, distortion hardly occurs. Moreover, by surface treatment depending on the material of the seal ring, the sliding performance and reliability are enhanced.

In a different aspect, of the main body and lid, the material of the side sliding with the seal ring member and the material of the side not sliding with the seal ring member are different. In such constitution, only the material of the side sliding with the seal ring member may be made of a material excellent in sliding performance with the seal ring member.

(6) (corresponding to FIG. 8) In the helical blade type compressor of (2), the inside diameter of the cylinder inner circumference of the portion contacting with the seal ring member is different from the inside diameter of the portion in which the helical blade of the cylinder is disposed.

According to such constitution, the thrust load acting on the roller by the seal ring member can be set depending on the magnitude of the thrust load acting on the roller by the helical blade (in the reverse direction of the thrust load by the seal ring member). Therefore, one thrust load can be set larger than the other thrust load, so that the roller can be pressed in one direction so as to be stabilized in motion. As a result, the vibration and noise can be decreased.

In one aspect, the inside diameter of the cylinder inner circumference of the portion contacting with the seal ring member is larger than the inside diameter of the portion in which the helical blade of the cylinder is disposed.

In other aspect, the inside diameter of the cylinder inner circumference of the portion contacting with the seal ring member is smaller than the inside diameter of the portion in which the helical blade of the cylinder is disposed.

According to such constitution, an adequate thrust load is obtained depending on whether the pressure in the case is low or high.

(7) (corresponding to FIG. 9, FIG. 10, and FIG. 11) In the helical blade type compressor of (2), the annular ring and the seal ring member to be inserted in the annular ring are provided in a plurality each, and an intermediate pressure lead-in path for leading in a compression intermediate pressure from the compression chamber is provided in at least one position of the spaces divided by the plural seal ring members.

According to such constitution, by leading the intermediate pressure into the space partitioned by the seal ring members, the pressure difference acting on each seal ring member may be stably controlled. Accordingly, the sealing performance is stabilized, and the reliability is also enhanced.

In one aspect (corresponding to FIG. 9), the intermediate pressure lead-in path is provided at the roller side.

In other aspect (corresponding to FIG. 10), the intermediate pressure lead-in path is provided at the cylinder side.

In a different aspect (corresponding to FIG. 11), the intermediate pressure lead-in path is provided at the cylinder and roller sides.

In such constitution, the intermediate pressure can be led in more securely.

(8) (corresponding to FIG. 12) In the helical blade type compressor of (1), the seal member is freely inserted into an annular groove provided in the cylinder inner circumference, and abuts against the annular groove and roller to separate into the pressure in the case and the pressure in the compression chamber.

Contrary to the structure in (2), the seal ring member can be provided at the cylinder side, and similar actions and effects are obtained in such constitution.

(9) (corresponding to FIG. 13) In the helical blade type compressor of (8), the cylinder is composed of at least two or more members that can be divided in the portion of the annular groove.

According to such constitution, the seal ring member may be easily fitted in the annular groove. In particular, the seal ring member not having divided portion or the sealing member made of hard material may be fitted easily.

In one aspect (corresponding to FIG. 13), the two or more members are fixed by bolts by inserting a packing between them. in such constitution, the sealing performance of the divided portion is enhanced.

In other aspect (corresponding to FIG. 13), the two or more members are made of same material, and the surface is treated by nitriding, Ni—P—B plating or other surface treatment depending on the material of the seal ring member. In such constitution, the coefficient of thermal expansion of the members is the same, and therefore if temperature rise occurs during operation, distortion hardly occurs. Moreover, by surface treatment depending on the material of the seal ring, the sliding performance and reliability are enhanced.

In a different aspect (corresponding to FIG. 13), of the two or more members, the material of the side sliding with the seal ring member and the material of the side not sliding with the seal ring member are different. In such constitution, only the material of the side sliding with the seal ring member may be made of a material excellent in sliding performance with the seal ring member.

(10) (corresponding to FIG. 14, FIG. 15 and FIG. 16) In the helical blade type compressor of (8), the annular groove in which the seal ring member is fitted is divided by a receiving member holding one end of the cylinder and the end of the roller, and the seal ring member abuts against the receiving member and the roller to separate into the pressure in the case and the pressure in the compression chamber.

According to such constitution, the seal ring member may be fitted easily, and the structure is simplified.

(11) (corresponding to FIG. 15) In the helical blade type compressor of (1), the seal member is inserted into the annular groove provided at the end of the roller, and cooperates with a receiving member for holding the end of the roller to separate into the pressure in the case and the pressure in the compression chamber.

According to such constitution, the seal member may be fitted easily, and in particular the seal ring member can be installed without disassembling the roller or cylinder.

In one aspect (corresponding to FIG. 16), the annular groove is opened to the outer circumferential side of the roller.

In other aspect (corresponding to FIG. 17), the annular groove is opened to the inside of the roller.

In such constitution, the annular groove can be processed easily, and a sufficient sealing performance is obtained.

(12) (corresponding to FIG. 18) In the helical blade type compressor of (1), the seal member is inserted in the annular groove provided in a receiving member for holding the end face of the roller, and cooperates with the end face of the roller to separate into the pressure in the case and the pressure in the compression chamber.

According to such constitution, the seal member may be fitted easily, and in particular the seal ring member can be installed without disassembling the roller or cylinder.

(13) (corresponding to FIG. 19) In the helical blade type compressor of (11), an intermediate pressure lead-in path is provided for leading in a compression intermediate pressure into the seal member from the compression chamber.

According to such constitution, as an intermediate pressure gas smaller than the discharge pressure acts at the back side of the seal member, the gas load acting on the seal ring is decreased, so that the reliability of the apparatus is enhanced.

(14) (corresponding to FIG. 20) In the helical blade type compressor of (11), the annular ring and the seal ring member to be inserted in the annular ring are provided in a plurality each, and an intermediate pressure lead-in path for leading in a compression intermediate pressure from the compression chamber is provided in at least one position of the spaces divided by the plural seal ring members.

According to such constitution, the pressure difference acting on each seal member may be stably controlled, and the sealing performance and the reliability are also enhanced.

(15) (corresponding to FIG. 21) In the helical blade type compressor of (12), an intermediate pressure lead-in path is provided for leading in a compression intermediate pressure into the seal member from the compression chamber.

According to such constitution, as an intermediate pressure gas smaller than the discharge pressure acts at the back side of the seal member, the gas load acting on the seal ring is decreased, so that the reliability of the apparatus is enhanced.

(16) (corresponding to FIG. 22) In the helical blade type compressor of (12), the annular ring and the seal ring member to be inserted in the annular ring are provided in a plurality each, and an intermediate pressure lead-in path for leading in a compression intermediate pressure from the compression chamber is provided in at least one position of the spaces divided by the plural seal ring members.

According to such constitution, the pressure difference acting on each seal member may be stably controlled, and the sealing performance and the reliability are also enhanced.

(17) (corresponding to FIG. 23) In the helical blade type compressor of (1), the seal member includes a first seal ring member and a second seal ring member, the first seal ring member is freely inserted into the annular groove provided in the roller outer circumference, and abuts against the annular groove and cylinder to separate into the high pressure side and low pressure side, and the second seal ring member is inserted in the annular groove provided at the end face of the roller, and cooperates with a receiving member for holding the end face of the roller to separate the high pressure and low pressure.

According to such constitution, sealing is more reliable, and the thrust load can be adjusted appropriately.

In an aspect (corresponding to FIG. 23), the annular groove for fitting the second seal ring member is opened also to the roller outer circumferential side.

(18) (corresponding to FIG. 24) In the helical blade type compressor of (1), the seal member has a divided portion in one position along the circumferential direction, and is formed so as to be expanded in diameter.

According to such constitution, mounting is easy by expanding the diameter of the seal ring diameter.

In one aspect (corresponding to FIG. 25A), the divided portion of the seal ring member has six joint faces crossing orthogonally to each other. In such constitution, at least three joint faces are always in contact, and if there is a slight gap in other three joint faces, the high pressure and low pressure can be always separated and sealed. If the seal member is made of resin and the cylinder is metallic, that is, if the coefficient of thermal expansion is different, the dimensions can be adjusted by other three faces.

In other aspect (corresponding to FIG. 25B), the divided portion of the seal ring member has joint faces provided parallel to the thickness direction of the seal ring and inclined by a specified angle.

In a different aspect (corresponding to FIG. 25C), the divided portion of the seal ring member has three joint faces provided parallel to the thickness direction of the seal ring member.

In other different aspect (corresponding to FIG. 25D), the divided portion of the seal ring member has three joint faces provided parallel to the diametral direction of the seal ring member.

In a further different aspect (corresponding to FIG. 25E), the divided portion of the seal ring member has joint faces provided parallel to the diametral direction of the seal ring and inclined by a specified angle.

According to such constitution, the sealing performance is assured by a simple joint structure.

(19) (corresponding to FIG. 24, and FIGS. 25A to 25E) In the helical blade type compressor of (18), the divided portion has joint faces, and at least one of the joint faces is always positioned in the groove for the ring, along with revolution of the roller, if the seal ring member projects to the maximum extent from the groove for holding the seal ring.

According to such constitution, secure sealing is assured because at least one joint face is positioned in the groove for the ring.

(20) (corresponding to FIG. 26 and FIG. 27) In the helical blade type compressor of (1), the seal member has a seal ring member and a spring member for thrusting the seal ring member in the outer circumferential direction.

According to such constitution, since the seal ring member is pressed to the inner circumference of the cylinder by the thrusting force of the spring, stable sealing is realized.

In one aspect (corresponding to FIG. 28), the spring member is held by a guide groove formed in the inner circumference of the seal ring member.

In such constitution, the thrusting force of the spring member acts in good balance on the seal ring member.

In other aspect (corresponding to FIGS. 50A and 50B), the outside diameter of the seal ring member in the state before mounting is larger than the inside diameter of the member which contacts with its outer circumference.

In such constitution, since the outer surface of the seal ring member is elastically pressed against the member (cylinder) contacting with its outer circumference, so that the same effect as action of spring member is obtained.

(21) (corresponding to FIG. 29 and FIG. 31) In the helical blade type compressor of (1), the seal member is a seal ring member not having divided portion, and the seal ring member comprises a ring-shaped main body, a ring side annular groove provided on the outer circumference of the main body, and a sub-seal ring member fitted in the ring side annular groove.

According to such constitution, seal leak of the outer circumference of the seal ring can be effectively prevented by the sub-seal ring member.

(22) (corresponding to FIG. 30 and FIG. 32) In the helical blade type compressor of (1), the seal member is a seal ring member not having divided portion, and the seal ring member comprises a ring-shaped main body, a ring side annular groove provided on the inner circumference of the main body, and a sub-seal ring member fitted in the ring side annular groove.

According to such constitution, seal leak of the inner circumference of the seal ring can be effectively prevented by the sub-seal ring member.

(23) (corresponding to FIG. 33) In the helical blade type compressor of (1), the seal member is a seal ring member not having divided portion, and the seal ring member has a ring side annular groove opened at its outer circumferential side, and the section of the ring side annular groove is U-form or V-form, and the opening side is at high pressure.

(24) (corresponding to FIG. 33) In the helical blade type compressor of (1), the seal member is a seal ring member not having divided portion, and the seal ring member has a ring side annular groove opened at its inner circumferential side, and the section of the ring side annular groove is U-form or V-form, and the opening side is at low pressure.

In one aspect (corresponding to FIG. 33 and FIG. 43), a spring member is inserted in the ring side annular groove. In such constitution, an initial sealing force is obtained by the spring member, and therefore the sealing performance is stabilized.

In other aspect (corresponding to FIG. 34 and FIG. 35), a groove for sub-seal ring is formed in a member contacting with the seal ring, and a sub-seal ring member is fitted in the groove for sub-seal ring.

(25) (corresponding to FIG. 1, FIG. 2, FIG. 36, and FIG. 37) In the helical blade type compressor of (1), the seal member is a seal ring member having an outer circumference, an inner circumference, and a plane enclosing them, and the plane is composed so that the area sliding with the member contacting with the seal ring is smaller than the area not sliding.

According to such constitution, the surface pressure acting on the plane of the seal ring can be adjusted. By the adjustment, the sealing performance and reliability may be optimally controlled.

In an aspect (corresponding to FIG. 36 and FIG. 37), a clearance opened at the low pressure side is provided on the plane.

In this constitution, the surface pressure acting on the plane can be adjusted by the clearance. On the opposite side of the opening side of this clearance, a high pressure is acting on the whole, but since the clearance opened at the low pressure side is provided, when the surface pressure of the sliding surface rises, the force acting on the seal ring main body is raised at the same time.

If the pressing force is insufficient, by employing this structure, the sealing performance may be enhanced easily.

In other aspect (corresponding to FIG. 38), a clearance opened at the high pressure side is provided on the plane. In this constitution, when the surface pressure of the sliding surface drops, the force acting on the seal ring main body is lowered at the same time.

(26) (corresponding to FIG. 39) In the helical blade type compressor of (12), the seal member inserted in the annular groove at the end face of the roller is a seal ring member having seal member side annular grooves at the outer circumference and inner circumference, sub-seal ring members are inserted in these seal member side annular grooves, and it also has an intermediate pressure lead-in path for leading the compression intermediate pressure in the compression chamber to the opposite side of the sliding side of the seal ring.

(27) (corresponding to FIG. 40) In the helical blade type compressor of (26), a spring member is provided at an opposite side of the sliding surface of the seal ring.

According to such constitution, an initial sealing pressure can be obtained by the spring member, so that a stable sealing performance is assured even right after starting up.

In one aspect (corresponding to FIG. 41), a clearance not communicating with the inner and outer circumferential sides of the seal ring is formed on the sliding surface of the seal ring member, and moreover an intermediate pressure lead-in path for leading a compression intermediate pressure to the clearance is provided in the seal ring. In such constitution, since the intermediate pressure can be guided into the clearance confronting the sliding surface, the surface pressure on the sliding surface drops, and the force acting on the seal ring main body may be lowered at the same time.

In other aspect (corresponding to FIG. 42), the plural seal ring members are composed of ring-shaped main body, ring side annular groove disposed at the inner circumference of the main body, and sub-seal ring member fitted in the ring side annular groove.

In such constitution, seal leak of the seal ring inner circumference can be effectively prevented by the sub-seal ring member.

In a different aspect (corresponding to FIG. 43), the plural seal ring members have a ring side annular groove opened at the outer circumferential side thereof, and the section of the ring side annular groove is either U-form or V-form, and the pressure is higher at the opening side.

(28) (corresponding to FIG. 1 and FIG. 2) In the helical blade type compressor of (1), the material of the seal member is engineering plastic (resin).

According to such constitution, by using the engineering plastic material, it is easier to form and process, the elasticity and a certain rigidity are maintained, so that the seal structure excellent in mounting, sealing, sliding and reliability is presented.

In one aspect (corresponding to FIG. 1 and FIG. 2), the principal component of the material of the seal member made of engineering plastic is PEEK (polyether ether ketone). In such constitution, since the rigidity is high, heat resistance is excellent and coefficient of friction is low, it is suited to the case in which the load applied to the seal ring is large, and the reliability and sealing performance are enhanced. It is also possible to process by injection forming, and the manufacturing performance is superior.

In other aspect (corresponding to FIG. 1 and FIG. 2), the principal component of the material of the seal member made of engineering plastic is fluoroplastic composed of PEEK or PFA. In such constitution, the material is relatively soft, and it is effective to fit to the shape smoothly.

In a different aspect (corresponding to FIG. 1 and FIG. 2), the principal component of the material of the seal member made of engineering plastic is PI (polyimide).

In other different aspect (corresponding to FIG. 1 and FIG. 2), the principal component of the material of the seal member made of engineering plastic is PPS (polyphenylene sulfide).

According to such constitution, the seal member can be composed of a relatively inexpensive material.

(29) (corresponding to FIG. 44) In the helical blade type compressor of (1), the seal member is a seal ring member, and the inner end portion of the seal ring member to be inserted into the cylinder is chamfered.

According to such constitution, owing to the chamfering, after inserting the seal ring member, when inserting together with the roller into the cylinder, the chamfering acts as the guide of the outer circumference of the seal ring. Hence, the assembling performance is notably improved.

(30) (corresponding to FIG. 45) In the helical blade type compressor of (1), the seal member is a seal ring member, and the outer end portion of the seal ring member to be inserted into the cylinder is chamfered.

In this constitution, the same effect as in (29) is obtained.

(31) (corresponding to FIG. 51) A refrigeration cycle apparatus using the helical blade type compressor of (1), in which the refrigerant used in the refrigeration cycle is a refrigerant higher in condensation or evaporation pressure than R22.

When using a refrigerant high in condensation or evaporation pressure, the absolute pressure difference between the high pressure side and low pressure side of the cycle is higher. In such condition, the sealing performance of high and low pressure in the cylinder tends to be inferior, and the thrust load acting on the roller is larger. However, by using the seal member in the invention, the sealing performance is improved, and the thrust load can be adjusted, and it is particularly effective when using such refrigerant.

In one aspect, the refrigerant used in the refrigeration cycle is R32 or an HFC system refrigerant containing R32. That is, if using an HFC system refrigerant which is a substitute CFC, the same effect as in (72) is obtained.

In other aspect, the HFC system refrigerant used in the refrigeration cycle is a mixed refrigerant composed of R410A or R407C. By using an HFC system mixed refrigerant, the same effect as in (72) is obtained, and in particular, as compared with R22, R410A is higher in condensation pressure or evaporation pressure by about 1.5 times. The use of the seal ring in such condition is particularly effective means for enhancement of performance and reliability.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 50A and 50B are front view and plan view showing the assembling jig of the compression mechanism for explaining the fourteenth embodiment; and FIG. 51 is a structural diagram of a refrigeration cycle apparatus showing a fifteenth embodiment.

DETAILED DESCRIPTION OF THE INVENTION

Figure 1:
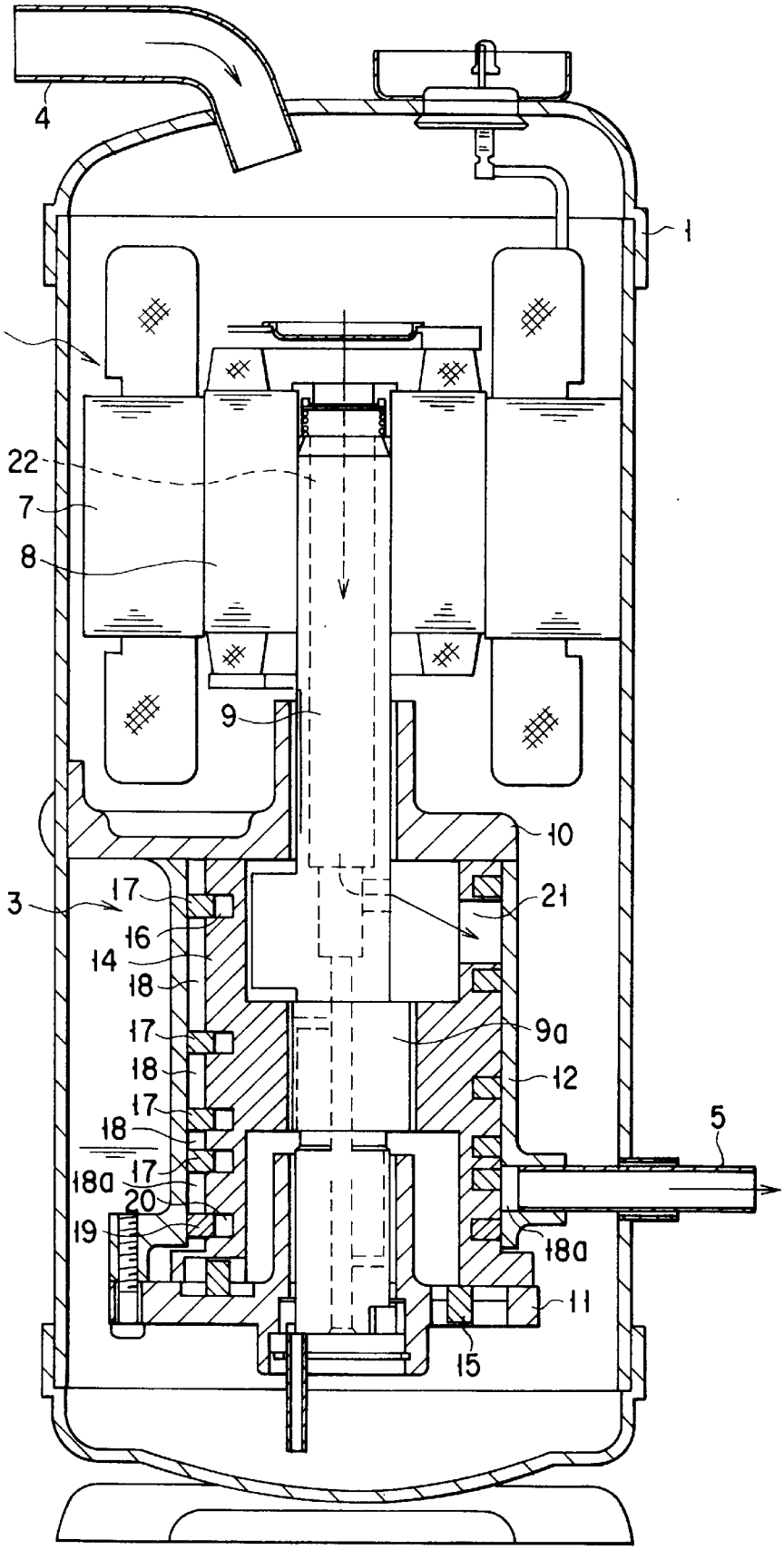
FIG. 1 is a longitudinal sectional view showing a first embodiment of the invention.

Referring now to the drawings, embodiments of the invention are described in detail below.

(First embodiment)

FIG. 1 is a longitudinal sectional view showing a helical blade type compressor (hereinafter called compressor) of a first embodiment.

This compressor comprises an enclosed case (hereinafter called case) 1, a motor 2 disposed in the upper part in the case 1, and a compression mechanism 3 disposed in the lower part in the case 1 and driven by the motor 2.

Figure 4:
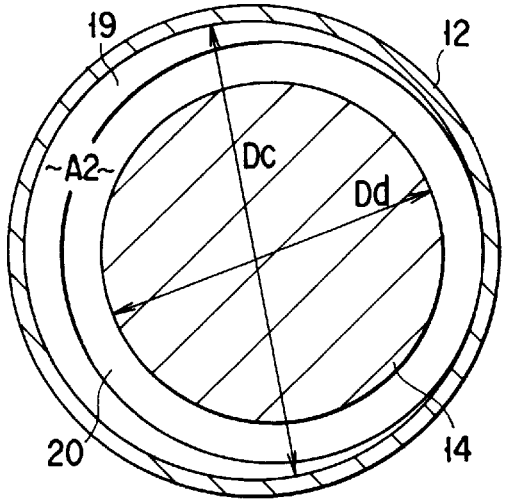
FIG. 4 is a cross sectional view along line IV—IV in FIG. 2.
Figure 5:
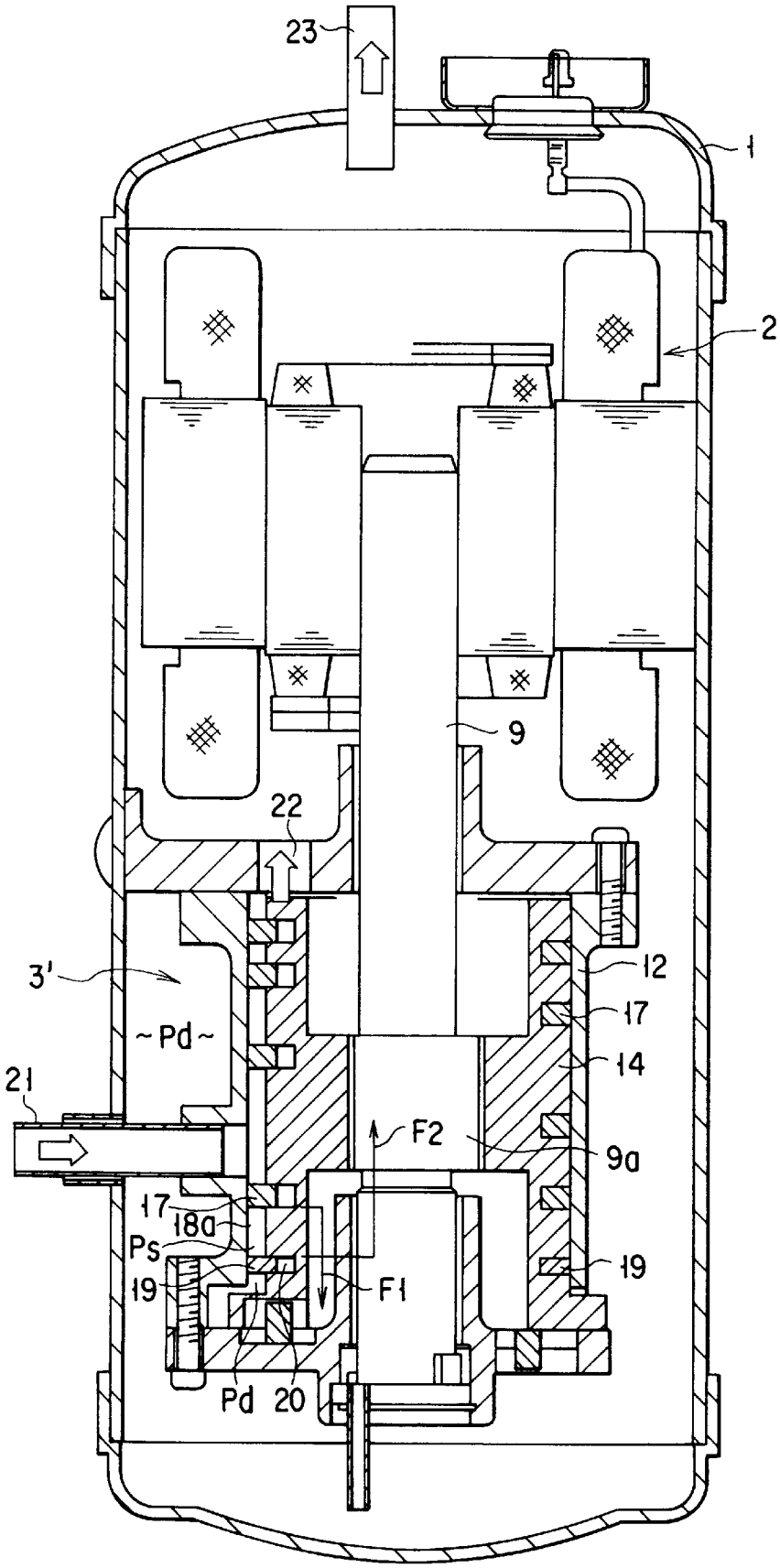
FIG. 5 is.a longitudinal sectional view showing a second embodiment.

The compressor in this embodiment is designed to suck a low pressure gas into the case 1 through a suction pipe shown in FIG. 4, compress in the compression mechanism 3, and discharge out of the case 1 through a discharge pipe shown in FIG. 5. Such compressor is generally called a "case internal low pressure type".

The motor 2 consists of a stator 7 fixed in the inner side of the case 1, and a rotor 8 which rotates in the stator 7. From the rotor 8, a crankshaft 9 having a crank 9*a* at the lower end side is projecting toward the compression mechanism 3 side.

On the other hand, the compression mechanism 3 has a main bearing member 10 and a subsidiary bearing member 11 for rotatably holding the crankshaft 9. Between the main bearing member 10 and subsidiary bearing member 11, a cylindrical cylinder 12 is held. The cylinder 12 has its upper end opening and lower end opening abutting against the lower surface of the main bearing member 10 and the upper surface of the subsidiary bearing member 11, respectively, and is held with its central axis coinciding with the center line of the crankshaft 9.

In the cylinder 12, further, a circular columnar roller 14 is held by the crank 9*a* of the crankshaft 9. Therefore, the roller 14 rotates eccentrically in the cylinder 12 as the crankshaft 9 is driven. At the maximum eccentric portion, as show in the diagram, part of the outer circumference contacts with the inner circumference of the cylinder 12.

Between the roller 14 and the subsidiary bearing member 11, an Oldham mechanism 15 for defining the rotation of the roller 14 is interposed. By the Oldham mechanism, the rotor 14 revolves about the axial line of the crankshaft 9 without rotating.

On the outer circumference of the roller 14, moreover, helical grooves 16 of uneven pitches are formed so that the pitch may be gradually narrower from top to bottom. In the helical grooves 16, helical blades 17 formed similarly in uneven pitches are fitted. Since the helical blade 17 is composed in such dimension that its outer surface may always abut elastically against the inner circumference of the cylinder 12, when the roller 14 rotates eccentrically in the cylinder 12, it projects from within the helical groove 16.

According to such constitution, at the outer side of the roller 14, a compression chamber 18 of a crescent cross section is formed by the inner circumference of the cylinder 12 and the helical blade 17. This compression chamber 18 moves helically from top to bottom while rotating in the peripheral direction when the roller 14 is driven eccentrically. The volume of the compression chamber 18 corresponds to the pitch of the helical blade 17, and becomes gradually smaller as moving downward. As a result, the gas contained in the compression chamber 18 is compressed.

At the lower end of the roller 14, a seal ring 19 is provided to partition the cylinder 12 into the high pressure side and low pressure side. The seal ring 19 is freely fitted in a groove 20 for seal ring provided in the roller 14 so as to abut always against the inner circumference of the cylinder regardless of eccentric rotation of the roller 14. According to such constitution, the highest pressure is achieved in the compression chamber 18*a* divided by the lower end portion of the helical blade 17 and the upper side of the seal ring 19.

Since this compressor is of case internal low pressure type, a suction port 21 for leading in the low pressure gas in the case 1 into the compression chamber 18 is provided at the upper end side of the roller 14. The low pressure gas in the case 1 is designed to be sucked into the suction port 21 through a low pressure gas path 22 provided in the crankshaft 9. At the lower end side of the cylinder 12, a discharge pipe 5 is provided in order to take out a high pressure gas from within the compression chamber 18*a* at the lowest end divided by the helical blade 17 and seal ring 19.

According to such seal ring structure, as explained below, the low pressure side and high pressure side can be sealed securely while adjusting the thrust load acting on the main bearing member 10 or subsidiary bearing member 11 from the roller 14. This effect is specifically described below while referring to FIG. 2.

Figure 2:
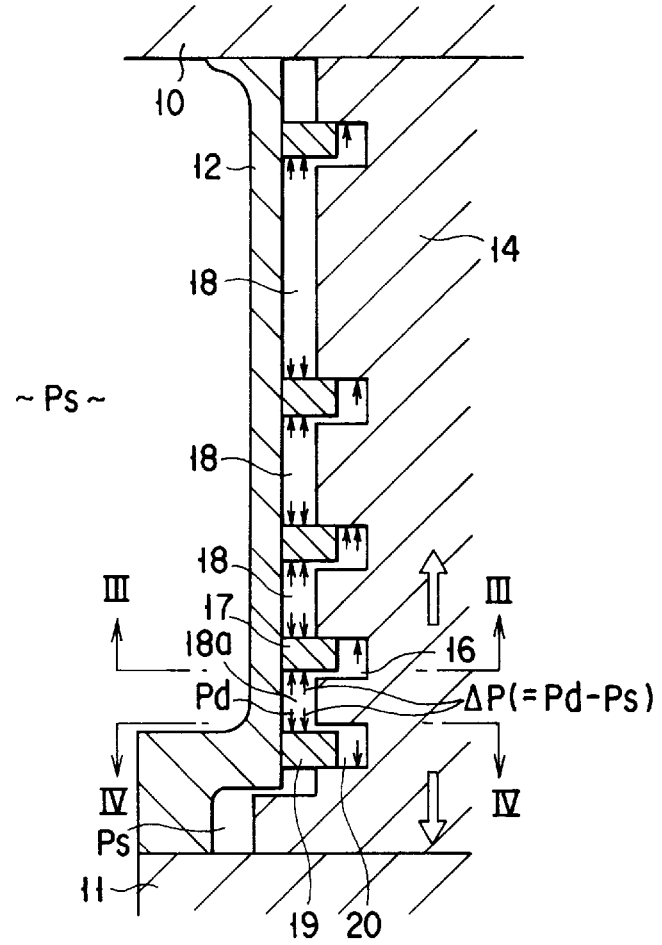
FIG. 2 is a longitudinal sectional view showing only the compression mechanism of the same.

FIG. 2 schematically describes the pressure state acting on the roller 14.

As shown in the diagram, the compression chamber 18*a* achieving the highest pressure is divided by the helical blade 17 and seal ring 19. The pressure in the compression chamber 18*a* acts on the lower surface of the helical blade 17 and the upper wall of the helical groove 16, and generates an upward thrust load F1 on the roller 14. On the other hand, the pressure in the same compression chamber 18*a* acts on the upper surface of the seal ring 19 and the lower wall of the groove 20 for seal ring, and generates a downward thrust load F2 on the roller 14.

Other compression chambers 18 than the compression chamber 18*a* achieving the highest pressure are partitioned by helical blades 17, and therefore the upward and downward thrust loads are canceled in each compression chamber 18. Hence, as the thrust load acting on the roller 14, it is enough only to consider the balance of thrust loads F1 and F2 generated in the compression chamber 18*a* achieving the highest pressure.

In the compression chamber 18*a,* when the pressure acting area at the helical blade 17 side and the pressure acting area at the seal ring 19 side are equal, the upward thrust load F1 and downward thrust load F2 are balanced, and the resultant force of the thrust load acting on the main bearing member 10 or subsidiary bearing member 11 may be regarded to be nearly 0.

Suppose the suction gas pressure, that is, the pressure of low pressure gas filling the case 1 to be Ps, and the discharge gas pressure, that is, the pressure of high pressure gas in the compression chamber 18*a* to be Pd. In this case, a differential pressure ΔP=Pd−Ps acts downward on the upper surface of the seal ring 19 and the bottom wall of the groove 20 for ring, and the same pressure ΔP acts also on the lower surface of the helical blade 17 and the upper wall of the helical groove 16.

The value obtained by integrating this differential pressure and he pressure acting area is equal to the thrust load F1 or F2.

First, the pressure acting area A1 and the thrust load F1 at the helical blade 17 side are discussed.

Figure 3:
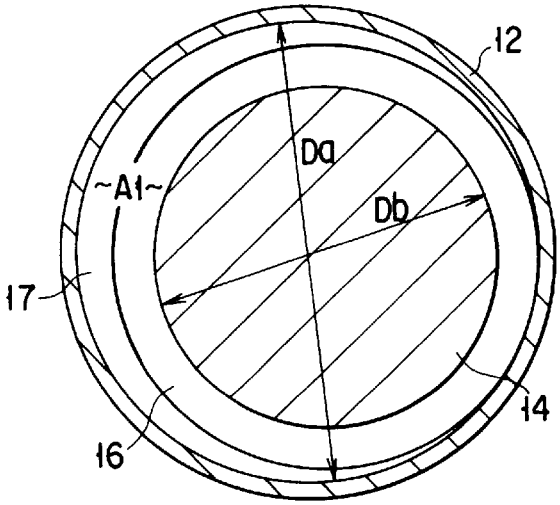
FIG. 3 is a cross sectional view along line III—III in FIG. 2.

FIG. 3 is a cross sectional view showing an arrow view of III—III in FIG. 2.

Supposing the inside diameter of the cylinder 12 to be Da and the outside diameter of the helical groove 16 to be Db, the pressure acting area A1 is $$A1=(Da^2-Db^2)\pi/4$$

and the thrust load F1 is $$\text{i } F1=\Delta P\cdot A1=\Delta P(Da^2-Db^2)\pi/4.$$

Next are discussed the pressure acting area A2 and the thrust load F2 at the seal ring 19 side.

FIG. 4 is a cross sectional view showing an arrow view of IV—IV in FIG. 2.

Supposing the outside diameter of the seal ring 19 to be Dc and the outside diameter of the groove 20 for seal ring to be Dd, the pressure acting area A2 is $$A2=(Da^2-Db^2)\pi/4$$

and the thrust load F2 is $$F2=\Delta P\cdot A2=\Delta P(Da^2-Db^2)\pi/4.$$

In this first embodiment, the outside diameter Dc of the seal ring 19 is designed to be equal to the inside diameter Da of the cylinder 12, and that the outside diameter Dd of the groove 20 for seal ring equal to the outside diameter Db of the helical groove 16. Hence, F1=F2, so that the thrust load acting on the roller 14 may be 0.

As clear herein, by properly designing the outside diameter of the seal ring 19 and the dimension of the groove 20 for ring, it is easy to define F1>F2 or F1<F2, and the allowance for adjustment of thrust load is wide.

That is, according to this seal ring structure, the low pressure side (the pressure in the case) and the high pressure side (the pressure in the compression chamber) can be sealed securely, and the thrust load between the main bearing member 10 and subsidiary bearing member 11 can be adjusted easily. Therefore, without causing excessive load on the roller 14, it is possible to seal securely.

As the material for the seal ring 19, a proper material may be used, and in particular, an engineering plastic material (resin material) is preferred. By the use of engineering plastic material, it is possible to form or process the seal ring 19 easily, and elongation and a certain rigidity may be assured, and a seal structure excellent in mounting, sealing, sliding and reliability may be presented.

In this case, by using PEEK (polyether ether ketone) as the principal component of the material of the seal ring 19, so that the seal ring 19 high in rigidity, excellent in heat resistance and small in coefficient of friction is presented. This material is suited to the case in which the load applied to the seal ring 19 is large, and the reliability and sealing performance are enhanced. It is also possible to process by injection forming, and the manufacturing performance is superior.

As the principal component of the seal ring 19 made of engineering plastic, fluoroplastic composed of PEEK or PFA may be used. These materials are relatively soft, and it is effective to fit to the shape smoothly.

Besides, the principal component of the seal ring 19 made of engineering plastic may be PI (polyimide), or PPS (polyphenylene sulfide). By using such materials, the seal ring 19 can be composed of a relatively inexpensive material.

(Second embodiment)

FIG. 5 is a schematic structural diagram showing a second embodiment. Same constituent elements as in the first embodiment are identified with same reference numerals.

As compared with the first embodiment relating to the helical blade type compressor of case internal low pressure type, the compressor of this embodiment is of case internal high pressure type.

That is, in the compressor of this embodiment, a low pressure gas is sucked directly into the cylinder 12 through a suction pipe 21 shown in the diagram. The helical blades 17 in this embodiment are formed to be gradually narrower in pitch from bottom to top, and the low pressure gas sucked into the cylinder 12 is gradually compressed as moving from bottom to top together with the compression chamber 18. The compressed high pressure gas is discharged into the case 1 through a discharge port 22 provided in the main bearing member 10. Besides, at the upper end of the case 1, a discharge pipe 23 for discharging the high pressure gas to outside of the case 1 is provided.

In this embodiment, too, the seal ring 19 is attached to the lower end of the roller 14. However, the compression chamber 18*a* divided by the seal ring 19 and the helical blade 17 is a low pressure Ps atmosphere, different from the first embodiment, while the lower side of the seal ring 19 is a high pressure Pd atmosphere. Therefore, an upward thrust load F2 corresponding to the pressure acting area by the seal ring 19 and the differential pressure ΔP=Pd−Ps acts on the seal ring 19. By balancing the thrust load F2 with the downward thrust load F1 acting on the roller 14 by the helical blade 17, the same effects as in the first embodiment are obtained.

(Third embodiment)

Figure 6:
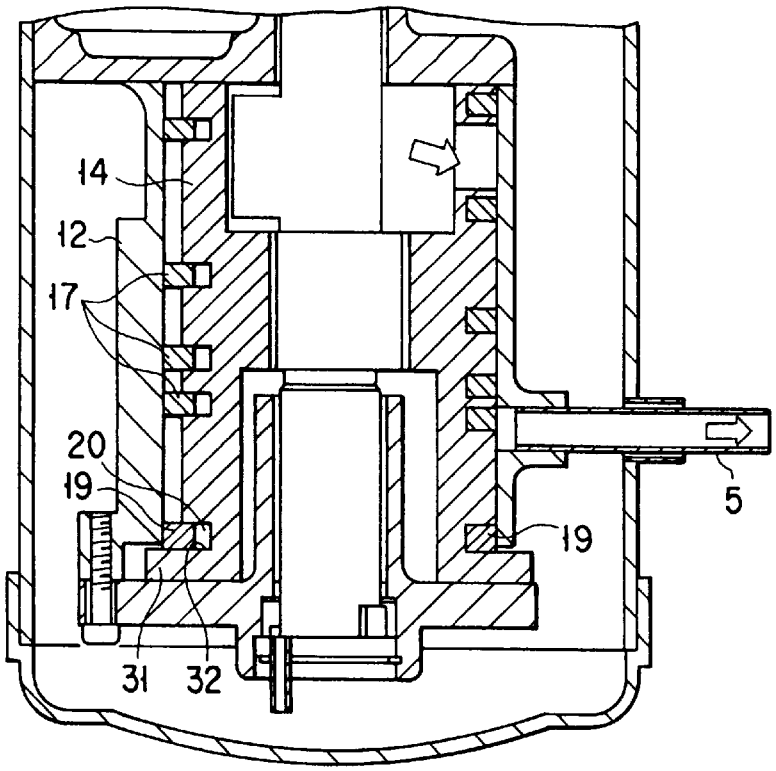
FIG. 6 is a longitudinal sectional view showing a third embodiment.
Figure 7:
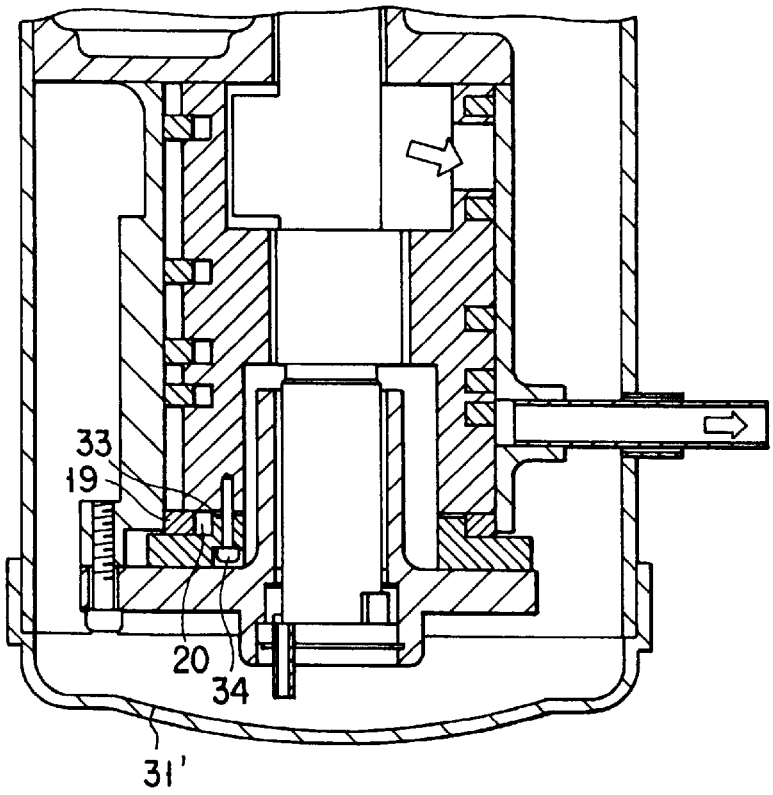
FIG. 7 is a longitudinal sectional view showing a modified example of the third embodiment.
Figure 8:
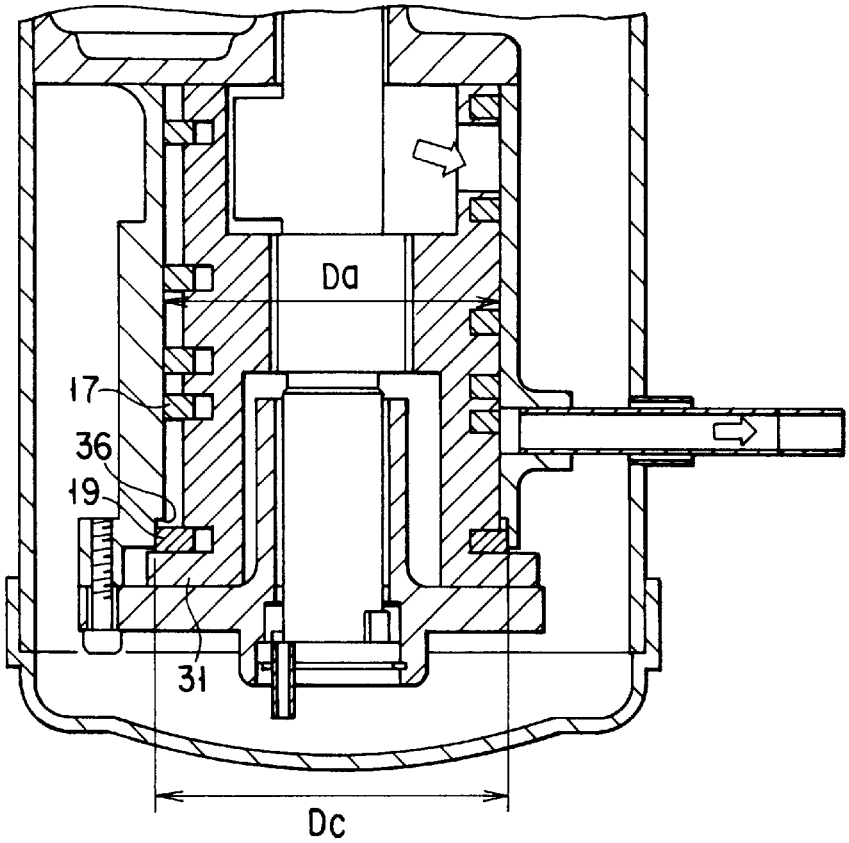
FIG. 8 is a longitudinal sectional view showing a modified example of the third embodiment.

Referring then to FIG. 6 to FIG. 8, a third embodiment is described.

FIG. 6 shows the compression mechanism 3 in the helical blade type compressor of case internal low pressure type.

At the lower end of the roller 14 in this embodiment, a roller flange 31 of a large diameter is formed. A groove 20 for seal ring for holding the seal ring 17 is formed so that its bottom may be flush with the upper surface of the roller flange 31, and this surface is a seal ring sliding surface 32.

In such constitution, since the outer circumference of the seal ring 19 can be held by the upper surface (seal ring sliding surface 32) of the roller flange 31, bending moment does not act on the section of the seal ring 19.

Therefore, breakage of the seal ring 19 may be effectively prevented, and the reliability is enhanced.

Moreover, in the constitution shown in FIG. 7, the roller flange 31 is formed as a roller flange part 31' that can be separated from the roller 14 (main body). The groove 20 for seal ring is formed so as to divide the roller flange pat 31' by joining with the lower surface of the roller 14. The roller flange part 31' is fixed by a junction bolt 34 in a state of inserting a seal member 33 such as packing into the junction of the roller 14.

In this embodiment, the roller 14 (main body) and roller flange part 31' are made of same material, and the sliding surface 32 with the seal ring 19 is treated by nitriding, Ni—P—B plating or other surface treatment, depending on the material of the seal ring 19.

In such constitution, the seal ring 19 can be detached or attached easily.

Still more, by using an appropriate material, the coefficient of thermal expansion is equal between the roller 14 and flange part 31', and if temperature rise occurs during operation, distortion hardly occurs. Besides, by surface treatment depending on the material of the seal ring 19, the sliding performance and reliability are enhanced.

Incidentally, if the roller flange part 31' and roller 14 are made of different materials, at least the material of the roller flange part 31' may be properly selected, or a proper surface treatment may be applied to the sliding surface 32.

On the other hand, in the constitution shown in FIG. 8, different from the constitution shown in FIG. 6, a step 36 is formed at the lower end of the cylinder 12 so that the inside diameter Da of the cylinder 12 in the portion sliding with the helical blade 17 and the inside diameter of the cylinder 12 in the portion sliding with the seal ring 19 (=seal ring outside diameter Dc) may be in the relation of Dc>Da.

According to such constitution, the thrust load acting on the roller 14 by the seal ring 19 can be set depending on the magnitude of the thrust load acting on the roller 14 by the helical blade 17 (in reverse direction of the thrust load by the seal ring 19). As a result, the former thrust load can be set larger than the latter thrust load, and the roller 14 can be pressed to the subsidiary bearing member 11 side, so that the motion can be stabilized. Hence, the vibration and noise can be decreased.

In the case of the case internal high pressure type, contrary to this embodiment, it may be set in the relation of Dc<Da.

(Fourth embodiment)

Figure 9:
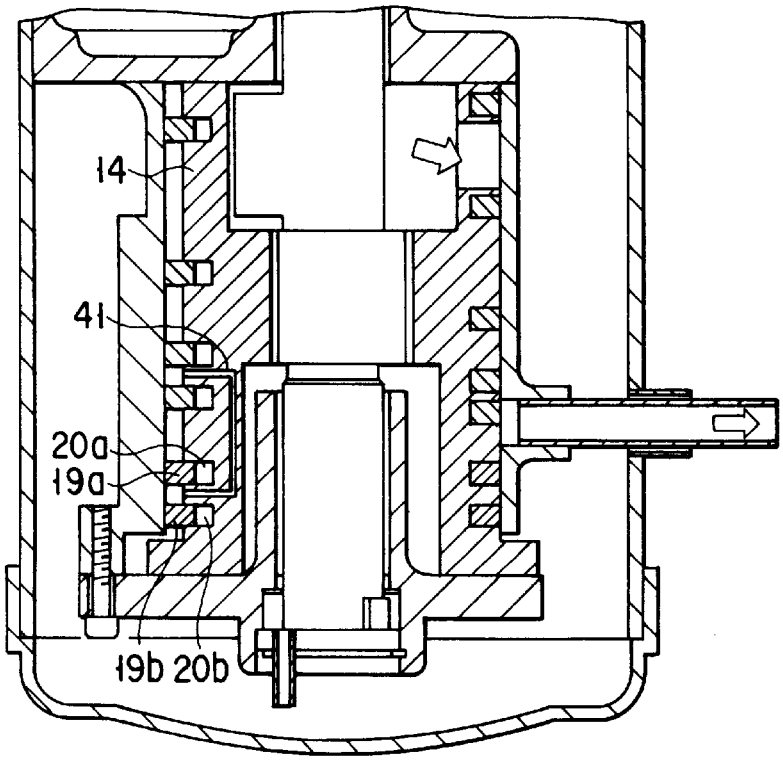
FIG. 9 is a longitudinal sectional view showing a fourth embodiment.
Figure 10:
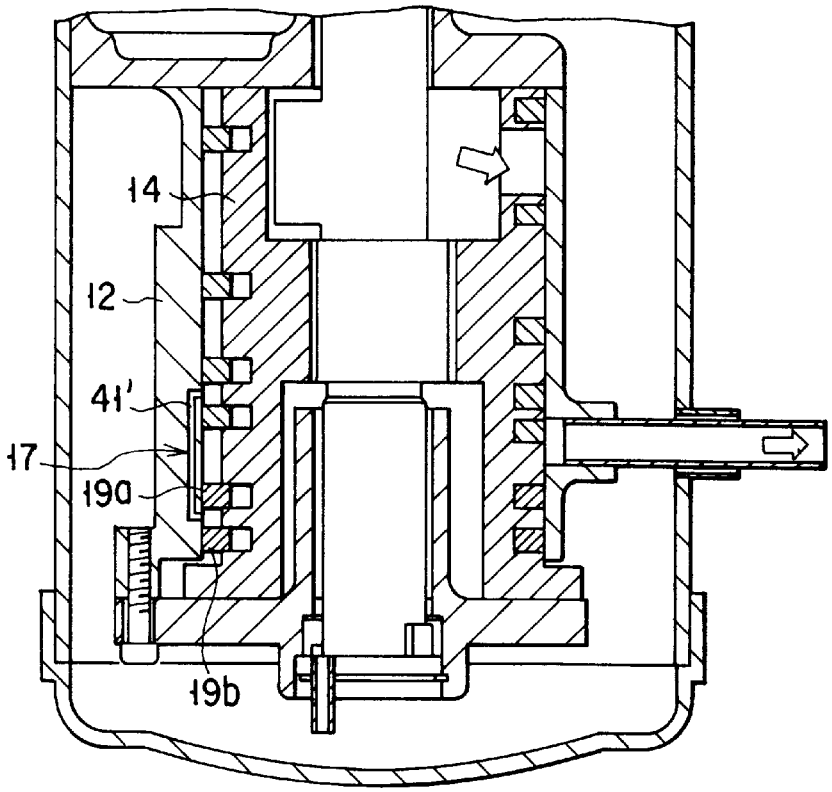
FIG. 10 is a longitudinal sectional view showing a modified example of the fourth embodiment.
Figure 11:
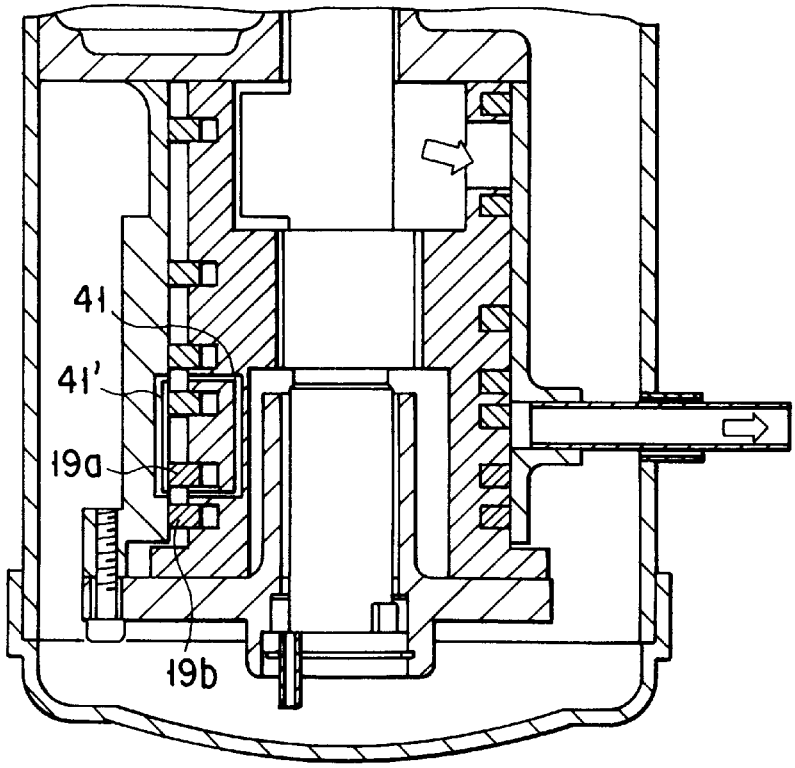
FIG. 11 is a longitudinal sectional view showing a modified example of the fourth embodiment.

Referring next to FIG. 9, FIG. 10 and FIG. 11, a fourth embodiment is described below.

This fourth embodiment relates to a constitution in which a plurality of seal rings are provided, and in the constitution shown in FIG. 9, FIG. 10 and FIG. 11, first and second seal rings 19*a,* 19*b* are fitted respectively into grooves 20*a,* 20*b* for first and second seal rings provided in the roller 14.

In the constitution shown in FIG. 9, in the space divided by the first and second seal rings 19*a,* 19*b,* an intermediate pressure lead-in path 41 for leading in the compressed intermediate pressure from the compression chamber 18 is provided.

In the constitution shown in FIG. 10, an intermediate pressure lead-in path 41' is provided at the cylinder 12 side, while the constitution shown in FIG. 11 has the two kinds of the intermediate pressure lead-in paths 41, 41'.

According to such constitutions, by leading the compressed intermediate pressure into the space partitioned by the first and second seal rings 19*a,* 19*b,* the pressure acting on the seal rings 19*a,* 19*b* may be controlled stably, and hence the sealing performance is stabilized and the reliability is enhanced.

(Fifth embodiment)

A fifth embodiment is described below while referring to FIG. 12 to FIG. 14.

Figure 12:
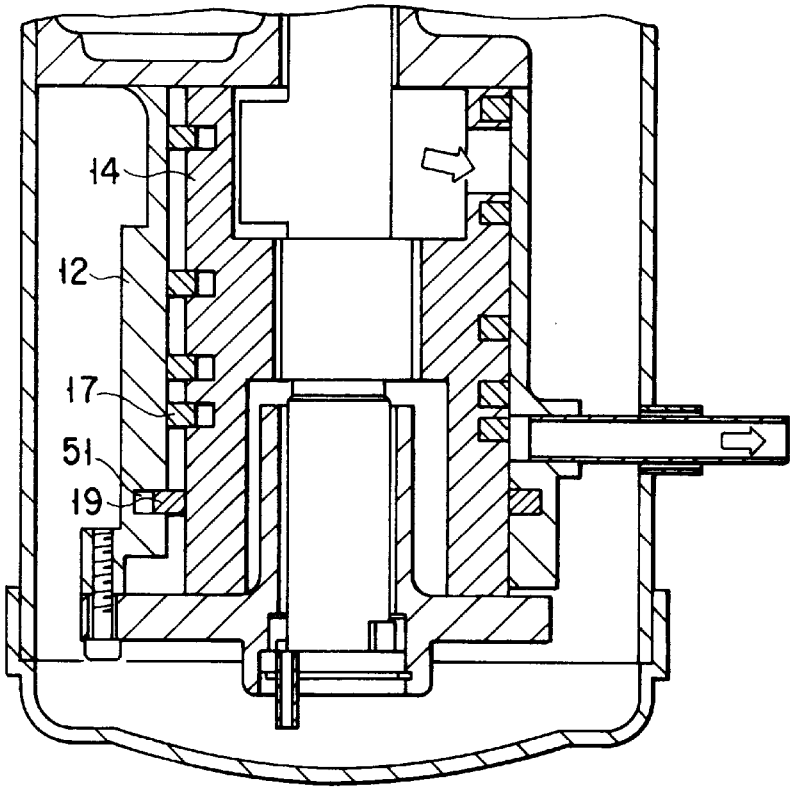
FIG. 12 is a longitudinal sectional view showing a fifth embodiment.

This embodiment, as shown in FIG. 12, relates to a constitution of forming a groove 51 for seal ring for holding the seal ring 19 at the cylinder 12 side.

Also in such constitution, the same effects as in the first embodiment are obtained.

Figure 13:
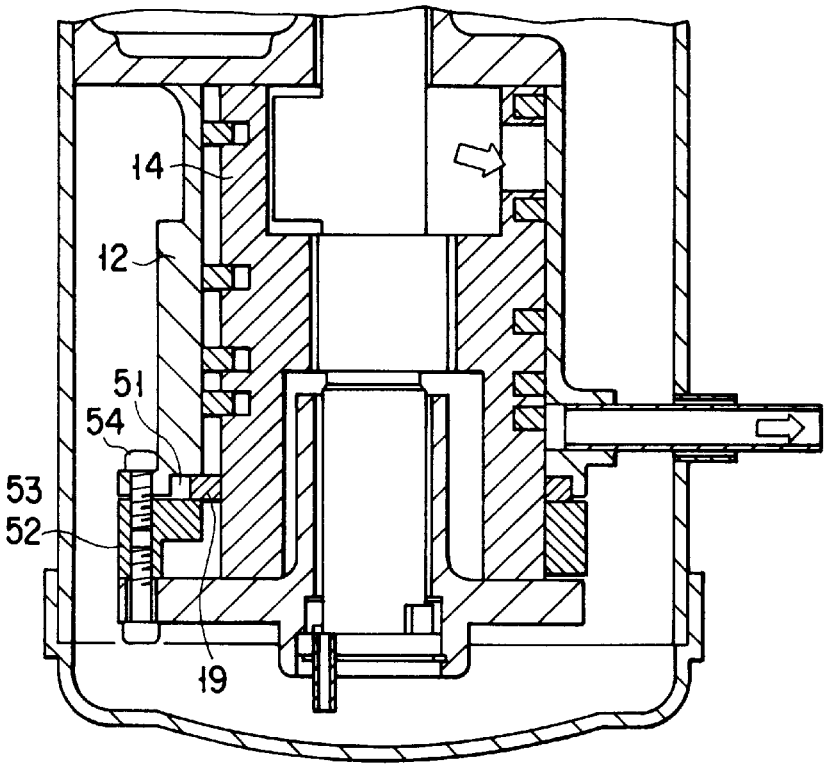
FIG. 13 is a longitudinal sectional view showing a modified example of the fifth embodiment.

In the constitution shown in FIG. 13, the cylinder 12 is divided into upper and lower sections by the portion of the groove 51 for seal ring, and the groove 51 for seal ring is divided by mounting a part 42 at the main body side of the cylinder 12. A packing 53 is inserted in the junction of the main body of the cylinder 12 and the part 52, and they are fixed by a mounting bolt 54 shown in the diagram.

In such constitution, the same effects as shown in FIG. 7 are obtained.

Figure 14:
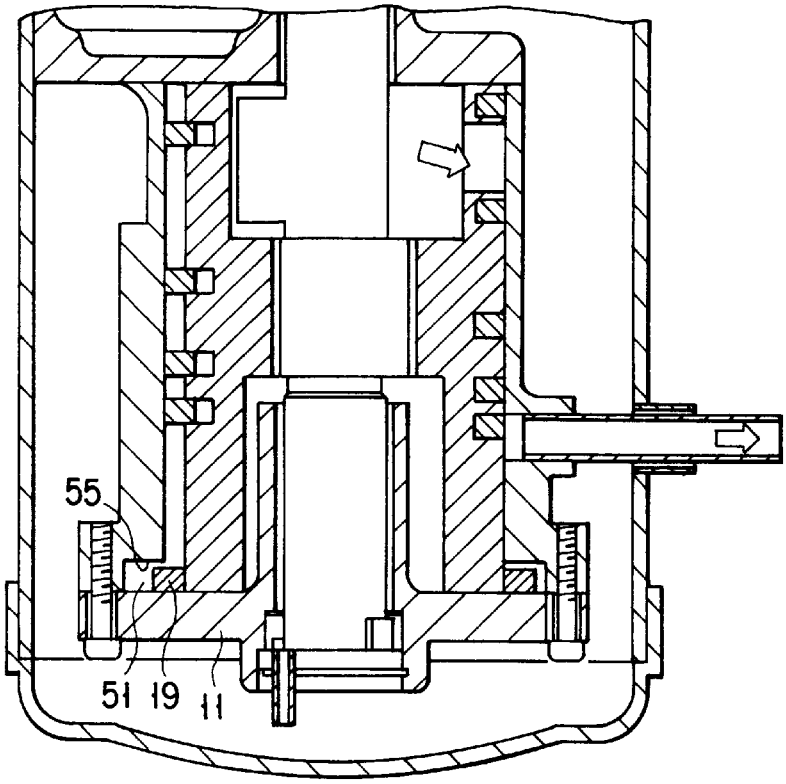
FIG. 14 is a longitudinal sectional view showing a modified example of the fifth embodiment.

In the example shown in FIG. 14, the groove 51 for seal ring is divided by a annular recess 55 formed at the lower end side of the cylinder 12 and the upper surface of the subsidiary bearing member 11.

In such constitution, same as shown in FIG. 8, occurrence of bending moment on the seal ring 19 can be effectively prevented.

(Sixth embodiment)

A sixth embodiment is described below while referring to FIG. 15 to FIG. 18.

This embodiment relates to a constitution in which the seal ring is provided on the sliding surface of the roller 14 and the subsidiary bearing member 11.

Figure 15:
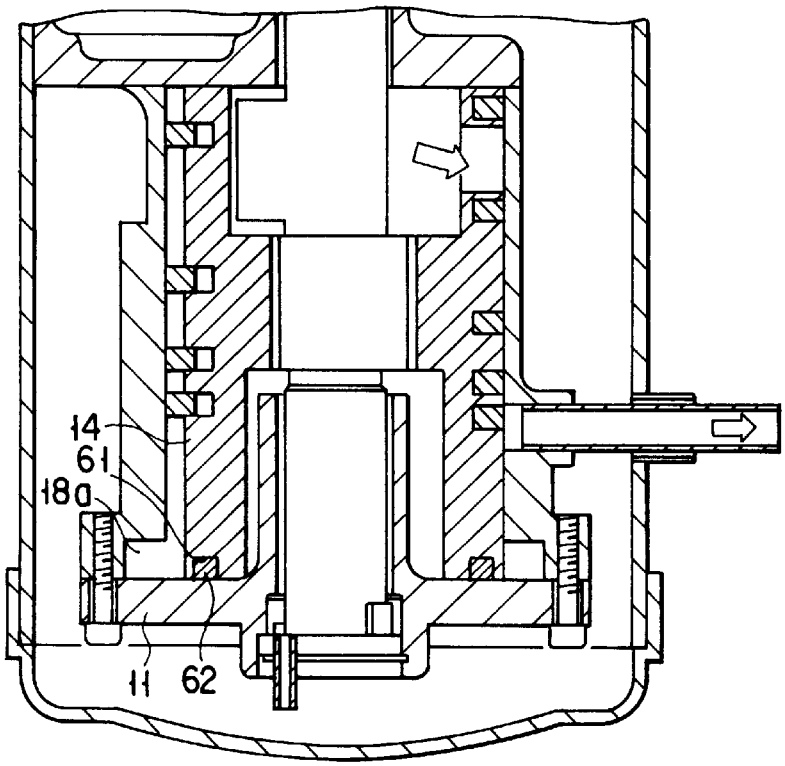
FIG. 15 is a longitudinal sectional view showing a sixth embodiment.
Figure 16:
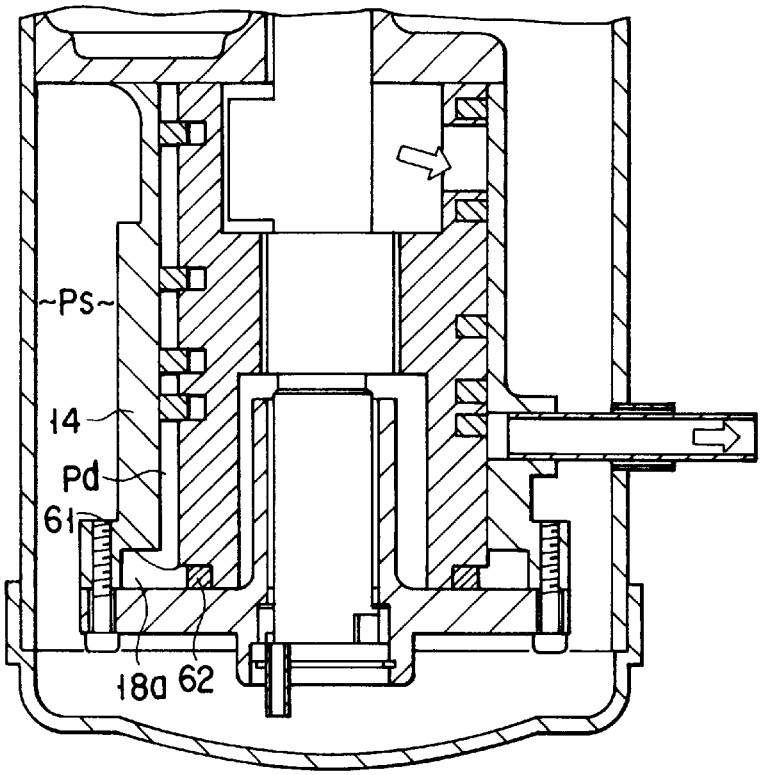
FIG. 16 is a longitudinal sectional view showing a modified example of the sixth embodiment.
Figure 17:
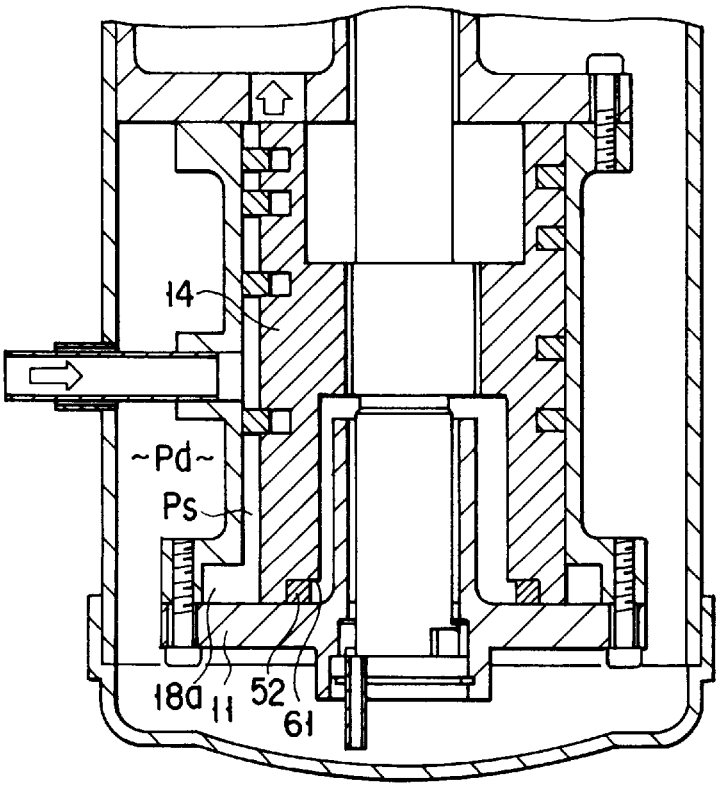
FIG. 17 is a longitudinal sectional view showing a modified example of the sixth embodiment.

First, in an example shown in FIG. 15 to FIG. 17, a groove 61 for seal ring is provided at the lower end of the roller 14, and a seal ring 62 if put in the groove 61 for seal ring.

In such constitution, too, the high pressure side (pressure in the compression chamber) and the low pressure side (the pressure in the case) can be sealed securely.

In the constitution shown in FIG. 16, the groove 61 for seal ring is formed to be opened to the outer circumferential side of the roller 14. This constitution is applied to the case internal low pressure type, and the seal ring 61 is pressed to the roller 14 side for receiving a high pressure in the compression chamber 18*a* on the outer circumference.

In the case of the case internal high pressure type, as shown in FIG. 17, the groove 61 for seal ring is composed to be opened to the inner circumferential side of the roller 14. In this constitution, the seal ring 61 receives a high pressure in the case 1 is received on the inner circumference, and is pressed to the roller 14 side.

Figure 18:
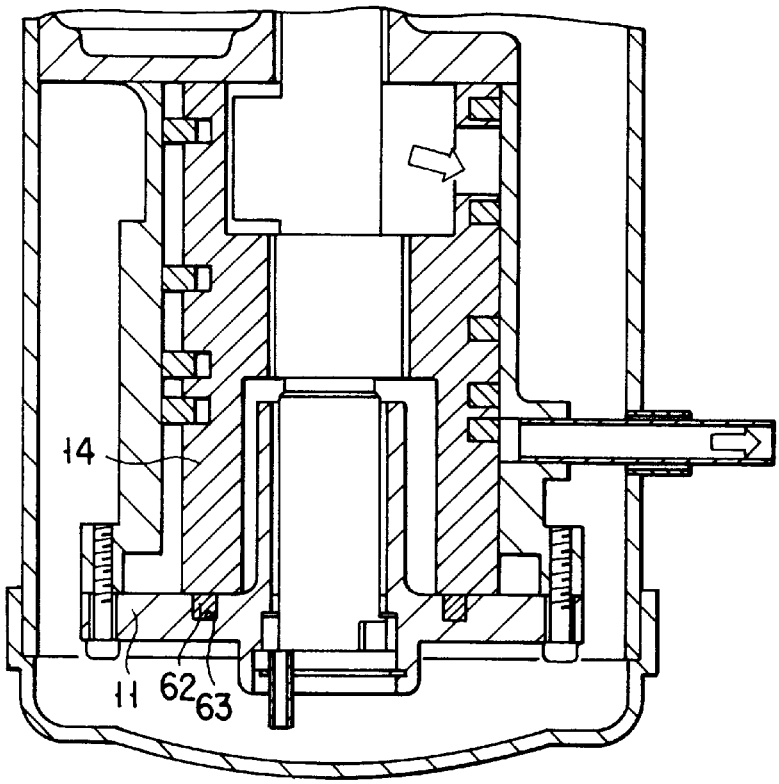
FIG. 18 is a longitudinal sectional view showing a modified example of the sixth embodiment.

In an example shown in FIG. 18, a groove 63 for seal ring is provided at the subsidiary bearing member 11 side, and a seal ring 62 is put in the groove 63 for seal ring. In this constitution, too, the same effects as shown in FIG. 15 are obtained.

(Seventh embodiment)

A seventh embodiment is described while referring to FIG. 19 to FIG. 22.

This embodiment, similar to the sixth embodiment, relates to a constitution of forming a seal ring 62 at the end of the roller 14, in which an intermediate pressure lead-in path 71 is provided at the side (back side) other than the sliding surface of the seal ring 62 for leading in a compressed intermediate pressure from the compression chamber 18 side.

Figure 19:
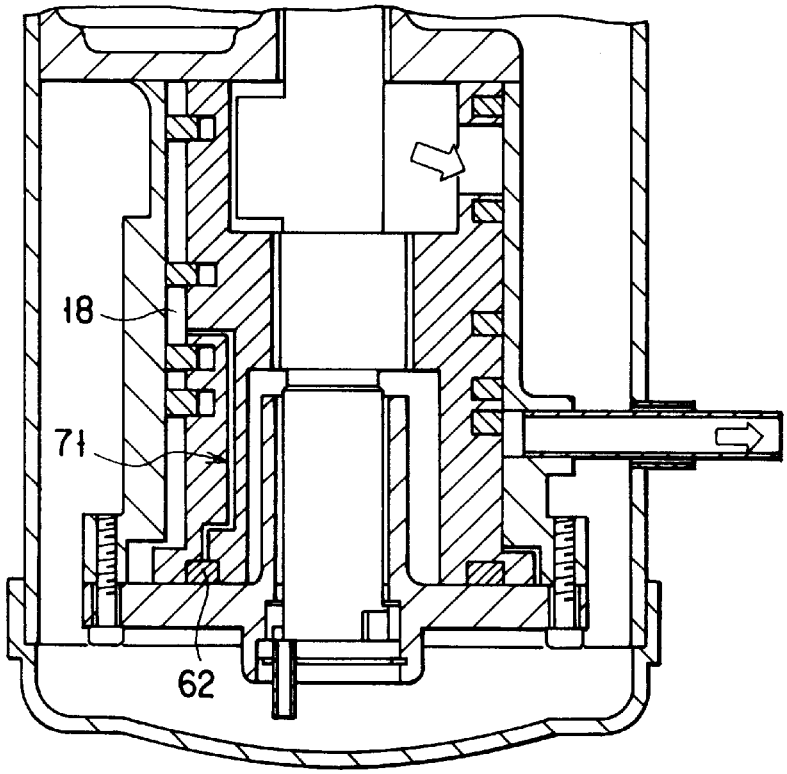
FIG. 19 is a longitudinal sectional view showing a seventh embodiment.
Figure 21:
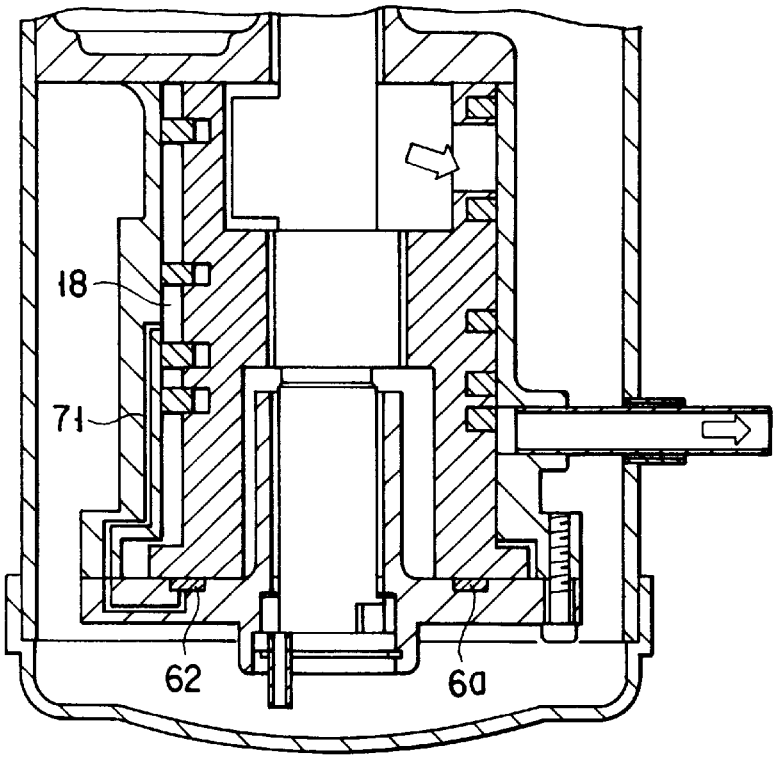
FIG. 21 is a longitudinal sectional view showing a modified example of the seventh embodiment.

In an example shown in FIG. 19, relating to the constitution in FIG. 15, the intermediate pressure lead-in path 71 is provided at the roller 14 side, and an example shown in FIG. 21 relates to a constitution shown in FIG. 18, in which the intermediate pressure lead-in path 71 is provided at the cylinder 12 and subsidiary bearing member 11 side.

According to such constitution, as the intermediate pressure smaller than the discharge gas pressure acts on the back side of the seal ring 62, the gas load acting on the seal ring 62 can be reduced, so that the reliability of the apparatus is enhanced.

Figure 20:
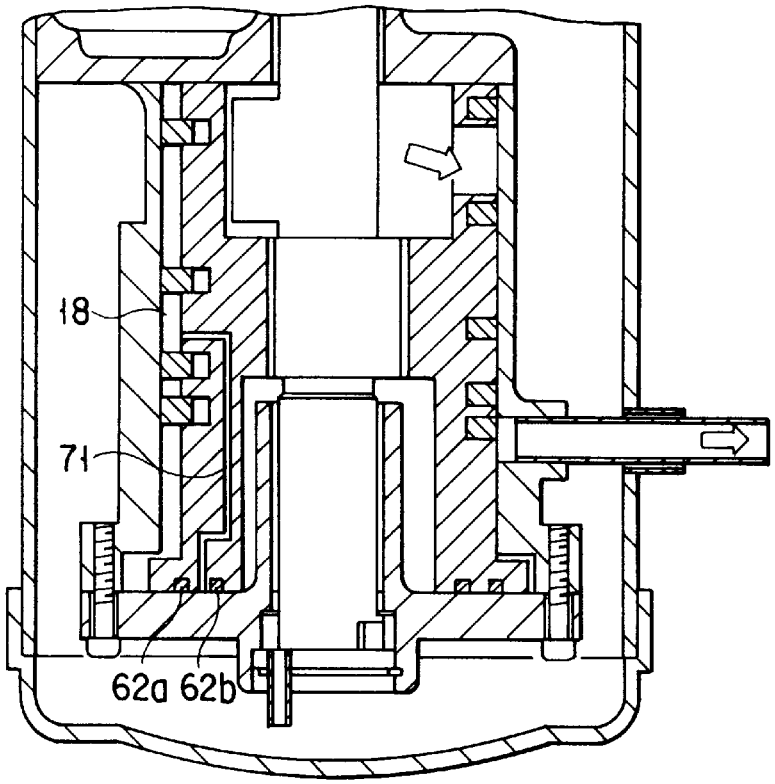
FIG. 20 is a longitudinal sectional view showing a modified example of the seventh embodiment.
Figure 22:
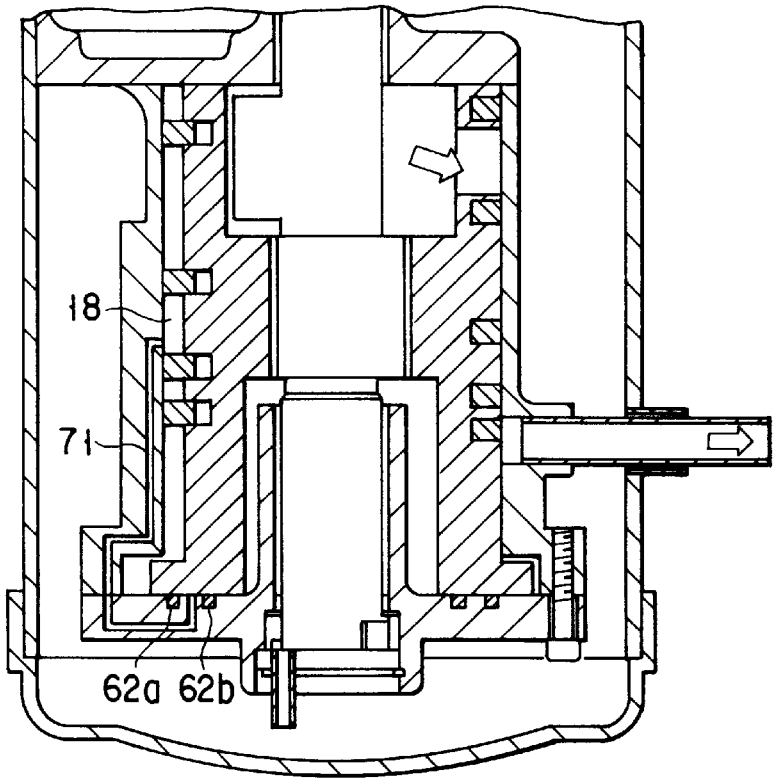
FIG. 22 is a longitudinal sectional view showing a modified example of the seventh embodiment.

Further, the seal ring 62 may be divided into two seal rings 61*a,* 61*b* as shown in FIG. 20 and FIG. 22, and in this case the intermediate pressure lead-in path 71 is connected to the space divided by the seal rings 61*a,* 61*b.*

In such constitution, the pressure difference acting on the seal rings 61*a,* 61*b* can be stably controlled, and the sealing performance and reliability are enhanced.

(Eighth embodiment)

Figure 23:
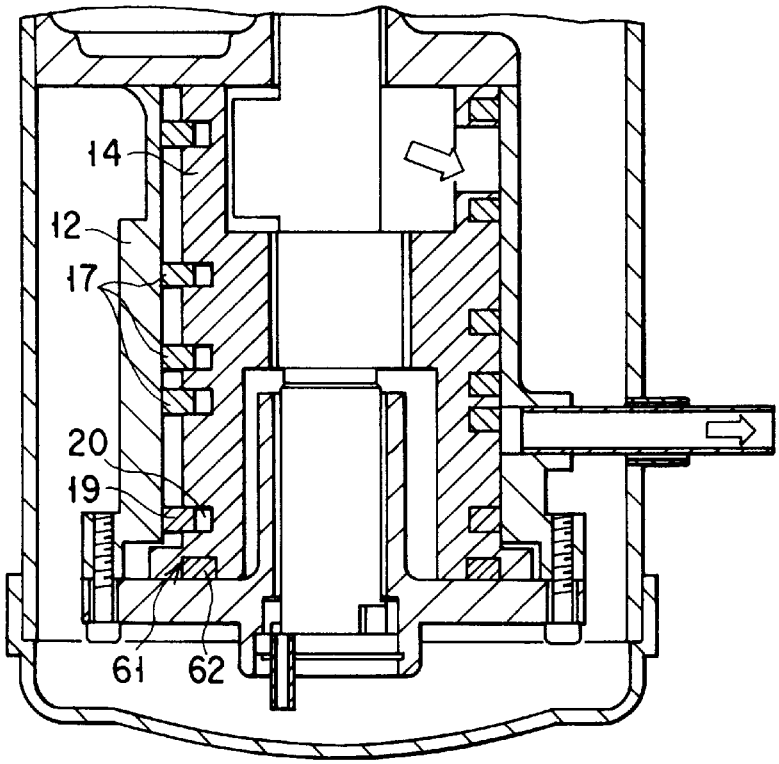
FIG. 23 is a longitudinal sectional view showing an eighth embodiment.

An eighth embodiment is described below while referring to FIG. 23.

This embodiment includes both the seal ring 19 in the first embodiment (FIG. 1) and the seal ring 62 in the sixth embodiment (FIG. 15) as the seal structure.

According to such constitution, effects of both first embodiment and sixth embodiment are obtained, secure sealing is realized, while adjustment of thrust load is also easy.

As the constitution of the grooves 20, 61 for seal ring for holding the seal rings 19, 62, the constitutions mentioned in the first to seventh embodiments may be appropriately employed. Of course, it can be also applied to the compressor of case internal high pressure type.

(Ninth embodiment)

A ninth embodiment is described below while referring to FIG. 24 and FIG. 25.

This embodiment relates to a specific constitution of the seal ring 19 (62).

Figure 24:
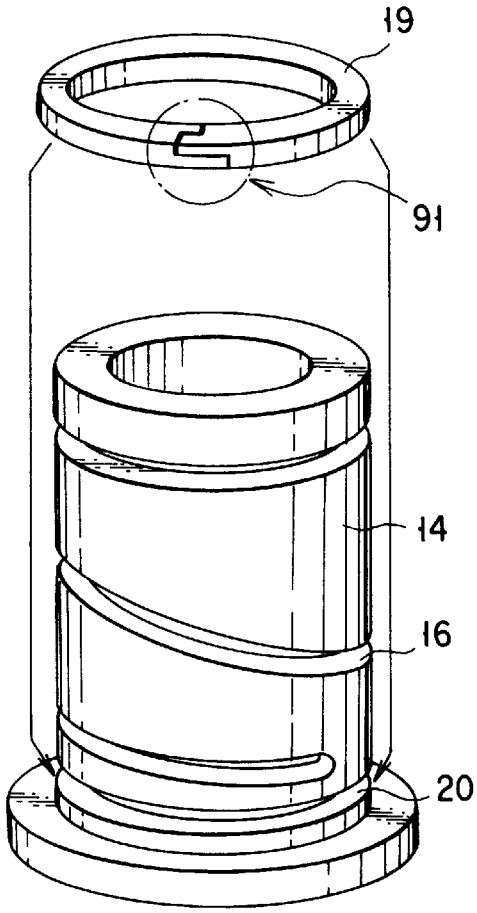
FIG. 24 is a perspective view showing a ninth embodiment.

FIG. 24 is a solid view of roller 14 and seal ring 19. Herein, the seal ring 19 has a junction 91 composed to be separable, in part in the circumferential direction. Therefore, by expanding the seal ring 19 in the portion of the junction 91, it can be easily fitted into the groove 20 for seal ring of the roller 14.

FIGS. 25A to 25E are enlarged views of the structure of the junction 91 of the seal ring 19.

Figure 25A:
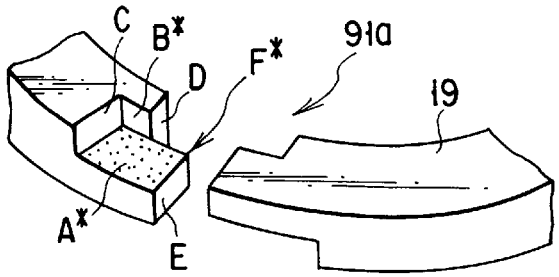
FIGS. 25A to 25E are perspective views showing the junction of the seal ring for explaining the ninth embodiment.

The junction 91*a* shown in FIG. 25A has two joint faces 1 to 6, and the asterisked faces 1, 2, 6 are always contacting during operation of the compressor and function as the seal means. Other three joint faces have a specified gap for absorbing difference in thermal expansion between the seal ring 19 and cylinder 12, and are not always contacting.

According to such constitution, while effectively absorbing dimensional difference due to thermal expansion between members, it is effective to seal securely.

Figure 25B:
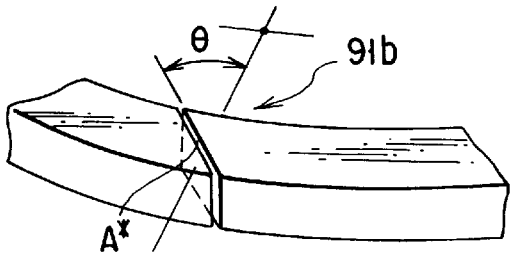

The junction 91*b* shown in FIG. 25B has a joint face 1 provided along the thickness direction of the seal ring 19, and the joint face 1 is inclined by a specified angle θ to the diametral direction of the seal ring 19. According to such constitution, the seal may be formed in a extended form.

Figure 25C:
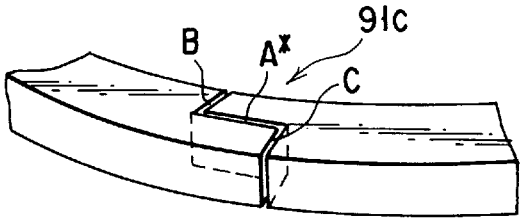

The junction 91*c* shown in FIG. 25C has three joint faces 1, 2, 3, and these joint faces 1, 2, 3 are formed along the thickness direction of the seal ring 19, that is, disposed in a key shape. In such constitution, the asterisked joint face 1 is always contacting during operation, and acts to keep sealing performance.

Figure 25D:
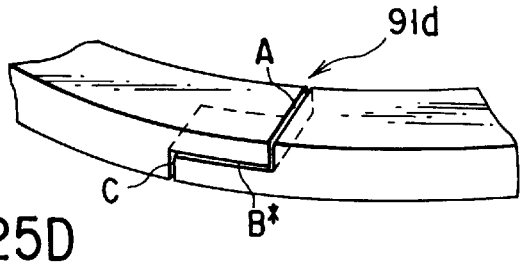

The junction 91*d* shown in FIG. 25D has three joint faces 1, 2, 3, and these joint faces 1, 2, 3 are formed parallel to the diametral direction of the seal ring 19, that is, disposed in a key shape. In such constitution, the asterisked joint face 2 among joint faces is always contacting during operation, and acts to keep sealing performance.

Figure 25E:
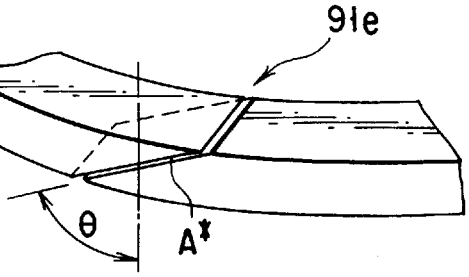

The junction 91*e* shown in FIG. 25E has a joint face provided along the diametral direction of the seal ring 19, and the joint face is inclined by a specified angle θ to the thickness direction of the seal ring 19. According to such constitution, the seal may be formed in a extended form.

(Tenth embodiment)

A tenth embodiment is described below while referring to FIG. 26, FIG. 27, and FIG. 28.

This embodiment relates to a constitution in which a spring member 101 is provided inside the seal ring 19 for thrusting the seal ring to the outside in the diametral direction.

Figure 26:
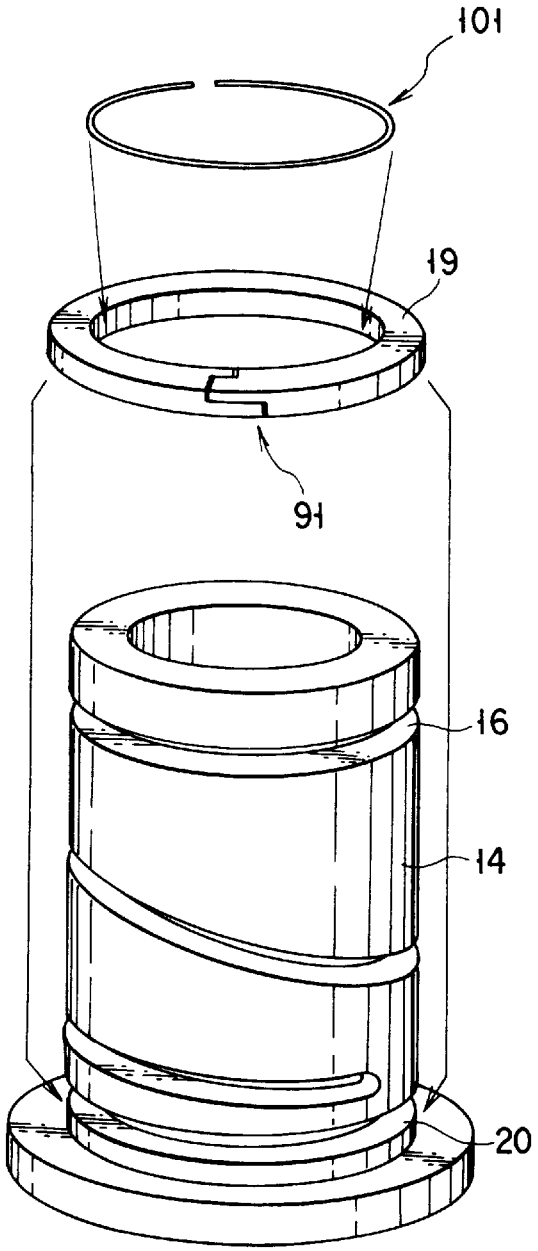
FIG. 26 is a perspective view showing a tenth embodiment.

FIG. 26 is a solid perspective view of roller 14, seal ring 19, and spring member 101. The spring member 101 is formed in a C-form, and is fitted to the inner circumference of the seal ring 19 while being compressed in the diametral direction.

The seal ring 19 has the junction 91, and it is fitted into the groove 20 for seal ring while expanding by the junction 91.

Figure 27:
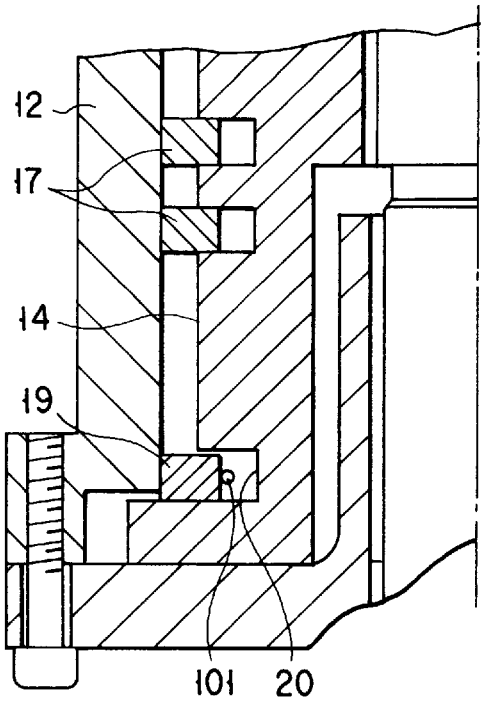
FIG. 27 is a longitudinal sectional view showing essential parts for explaining the tenth embodiment.

FIG. 27 is a longitudinal sectional view showing the configuration of the seal ring 19, groove 20 for seal ring, and spring member 101.

In such constitution, since the seal ring 19 is pressed against the inner circumference of the cylinder 12 by the thrusting force of the spring member 101, a more stable sealing effect is obtained.

Figure 28:
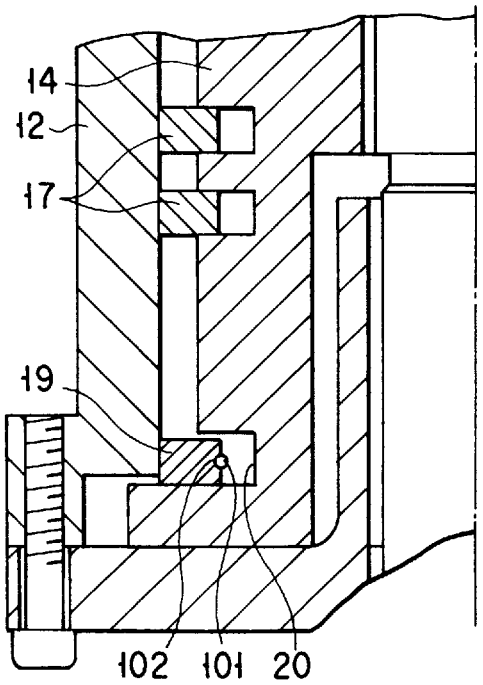
FIG. 28 is a longitudinal sectional view showing a modified example of essential parts of the tenth embodiment.

In an example shown in FIG. 28, a guide groove 102 is provided in the inner circumference of the seal ring 19 in order to hold the spring member 101 at the intermediate position in the thickness direction of the seal ring 19.

According to such constitution, the thrusting force of the spring member 101 acts on the seal ring 19 in a favorable balance.

(Eleventh embodiment)

An eleventh embodiment is described below while referring to FIG. 29 to FIG. 32.

Figure 29:
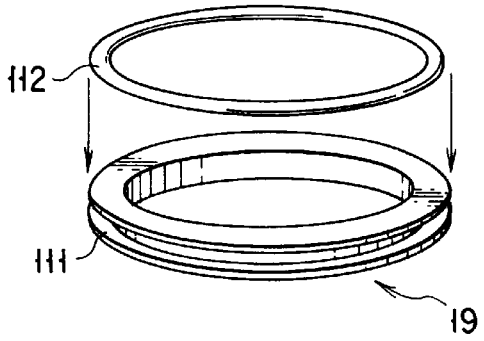
FIG. 29 is a perspective view showing s seal ring in an eleventh embodiment.

FIG. 29 relates to a seal ring 19 not having divided portion, in which an annular groove 111 is provided in its outer circumference, and a first sub-seal ring 112 is fitted in the annular groove 111.

Figure 30:
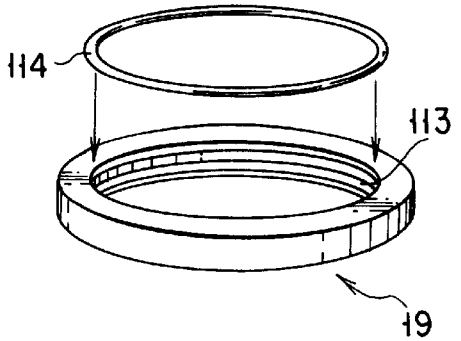
FIG. 30 is a perspective view showing s seal ring in the eleventh embodiment.

On the other hand, in FIG. 30 relating to a seal ring 19 without divided portion, an annular groove 113 is provided in its inner circumference, and a second sub-seal ring 114 is fitted in the annular groove 113.

Figure 31:
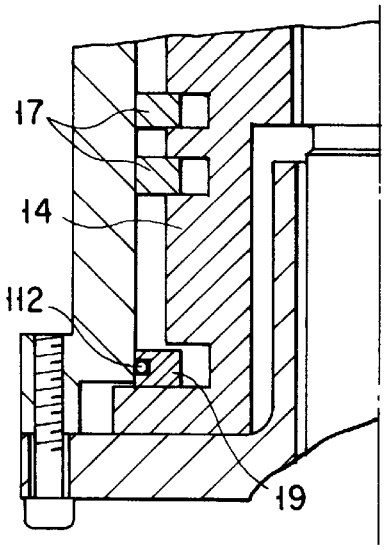
FIG. 31 is a longitudinal sectional view showing a mounting example of the eleventh embodiment.
Figure 32:
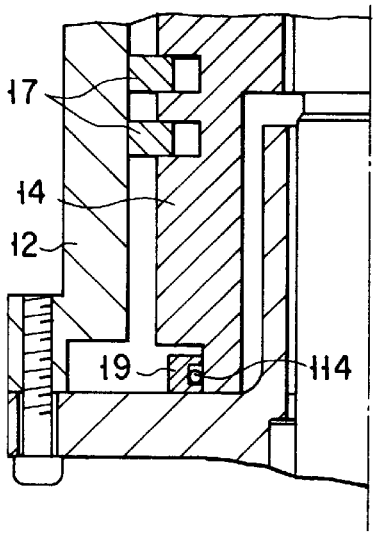
FIG. 32 is a longitudinal sectional view showing a mounting example of the eleventh embodiment.

FIG. 31 and FIG. 32 show the state of installation of thus constituted seal ring 19 in the groove for seal ring, 20, 61, formed in the roller 114.

According to such constitution, since divided portion is not provided in the seal ring 19, seal leak can be prevented effectively. Moreover, the sealing performance is enhanced by the sub-seal rings 112, 114.

Figure 33:
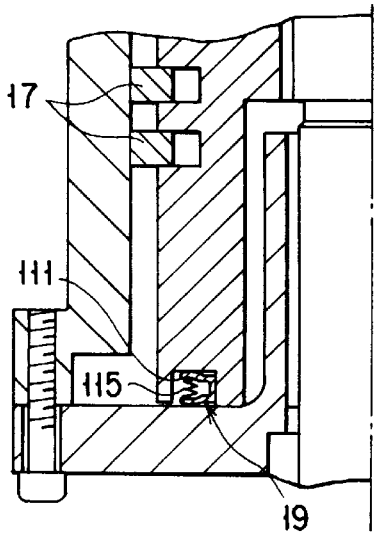
FIG. 33 is a longitudinal sectional view showing a mounting example of the eleventh embodiment.

In the constitution shown in FIG. 33, the annular groove 111 is formed in a section of U-form or V-form, and a spring member 115 is inserted in the annular groove.

In this embodiment, by properly selecting the opening direction of the annular grooves 111, 113 depending on the case internal high pressure type or case internal low pressure type, the pressure acting on the seal ring 19 can be adjusted.

(Twelfth embodiment)

Referring now to FIG. 34 to FIG. 38, a twelfth embodiment is described.

In this embodiment, the sub-seal rings 112, 113 are not provided at the seal ring 19 side, but are provided at the roller 14 or cylinder 12 side contacting with the seal ring 19.

Figure 34:
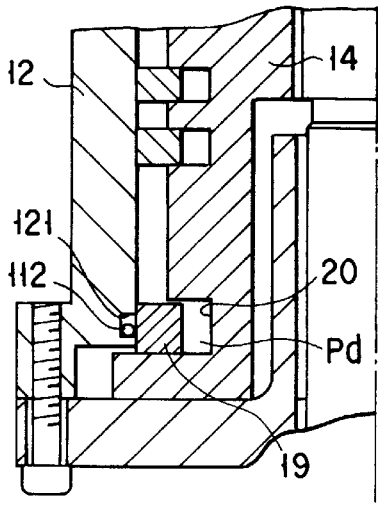
FIG. 34 is a longitudinal sectional view showing a twelfth embodiment.
Figure 35:
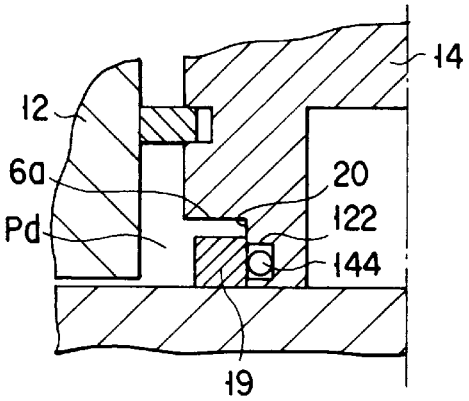
FIG. 35 is a longitudinal sectional view showing a modified example of the twelfth embodiment.

FIG. 34 shows an example in which a sub-seal ring 112 is held in a holding groove 121 opened at the cylinder 12 side, and FIG. 35 is an example in which a sub-seal ring 114 is held in a holding groove 122 opened at the roller 14 side.

In such constitution, the same effects as in the eleventh embodiment are obtained. In this example, preferably, it should be constituted depending on the case internal low pressure and high pressure types so that the pressure may be high at the opposite side of the side of the disposition of the sub-seal rings 112, 114.

Figure 36:
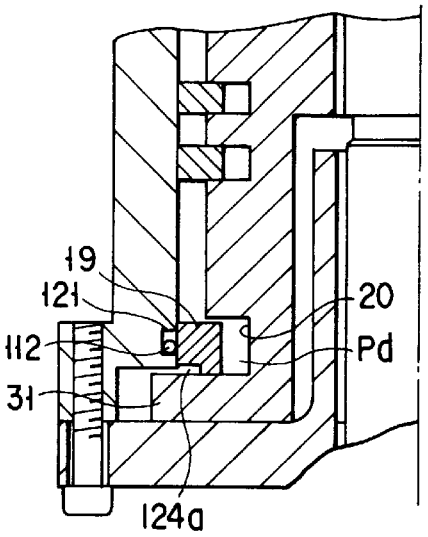
FIG. 36 is a longitudinal sectional view showing a modified example of the twelfth embodiment.
Figure 37:
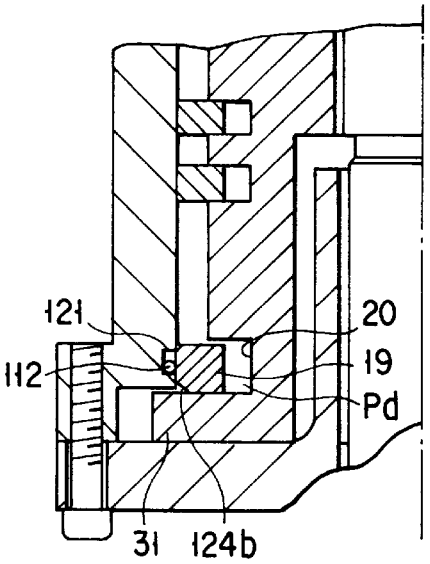
FIG. 37 is a longitudinal sectional view showing a modified example of the twelfth embodiment.
Figure 38:
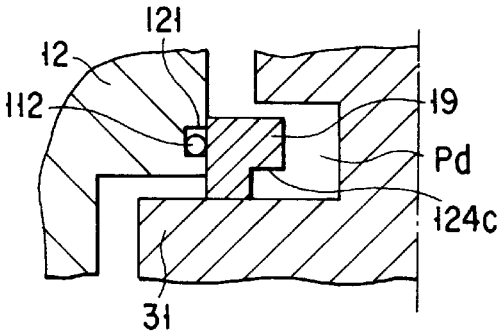
FIG. 38 is a longitudinal sectional view showing a modified example of the twelfth embodiment.

In FIG. 36 to FIG. 38, relating to the constitution shown in FIG. 34, clearances 124*a* to 124*c* are formed in the sliding surfaces of the seal ring 19 and the upper surface of the roller flange 31 in order to adjust the sliding surface area.

In such constitution, the surface pressure acting on the sliding surface of the seal ring 19 can be adjusted, and the sealing performance and the reliability may be optimally controlled.

(Thirteenth embodiment)

A thirteenth embodiment is described by reference to FIG. 39 to FIG. 43.

This embodiment is similar to the constitution of the seventh embodiment (FIG. 19), except that seal rings 112, 114 as explained in the eleventh embodiment are used as the seal ring 62.

Figure 39:
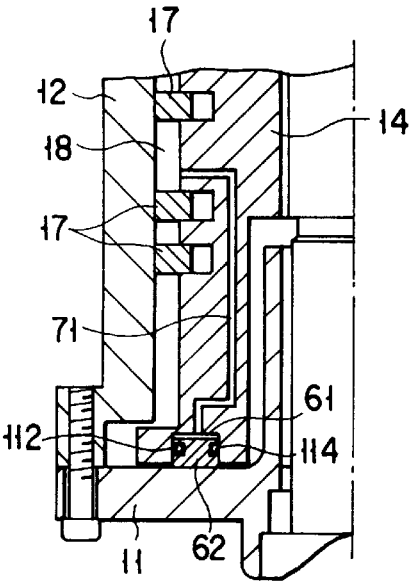
FIG. 39 is a longitudinal sectional view showing a thirteenth embodiment.

That is, as shown in FIG. 39, the seal ring 62 is contained in the groove 61 for seal ring provided at the lower end face of the roller 14. The seal ring 62 is provided with the sub-seal rings 112, 114, respectively, on the outer circumference and inner circumference. The intermediate pressure lead-in path 71 is constituted so as to communicate between the compression chamber 18 in the intermediate portion in the compression direction and the groove 61 for seal ring.

According to such constitution, same as in the seventh embodiment, it is easy to adjust the pressure acting on the seal ring 61, and secure sealing is realized.

Figure 40:
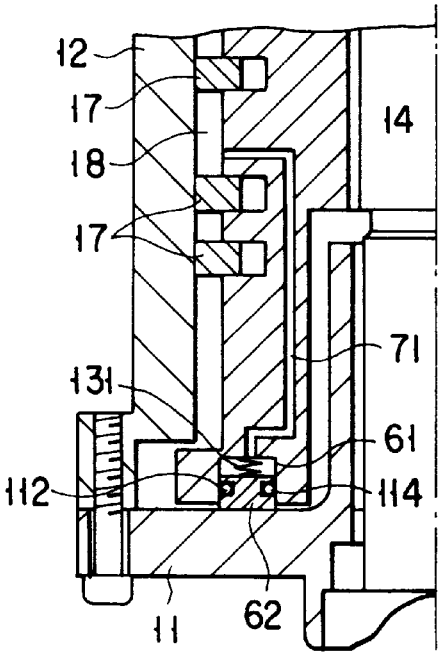
FIG. 40 is a longitudinal sectional view showing a modified example of the thirteenth embodiment.

FIG. 40 shows an example of installing a spring member 131 for pressing the seal ring 61 to the subsidiary bearing member 11, in the groove 61 for seal ring. In such constitution, an initial pressure can be applied to the seal ring 62, and a stable sealing performance from right after starting operation.

Figure 41:
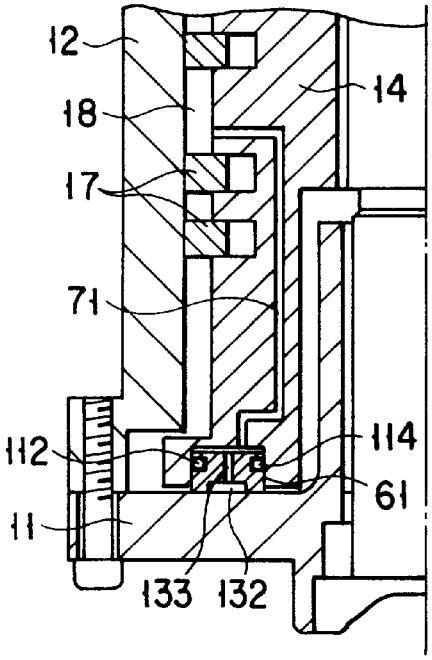
FIG. 41 is a longitudinal sectional view showing a modified example of the thirteenth embodiment.

In the constitution in FIG. 41, a clearance 132 is provided in the surface opposite to the sliding surface of the seal ring, and a small hole 133 for leading an intermediate pressure into the clearance 132 is formed.

According to such constitution, the surface pressure of the sliding surface can be lowered and the pressure acting on the seal ring 62 can be lowered.

Figure 42:
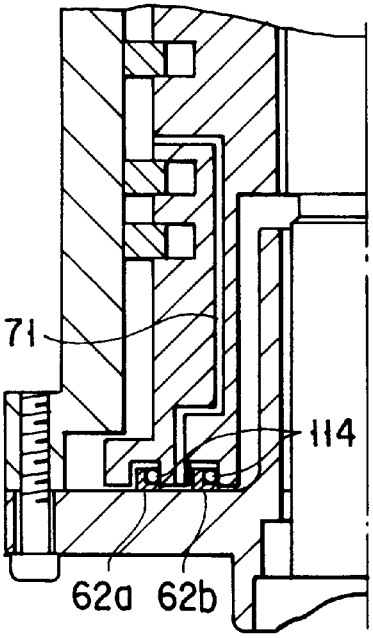
FIG. 42 is a longitudinal sectional view showing a modified example of the thirteenth embodiment.
Figure 43:
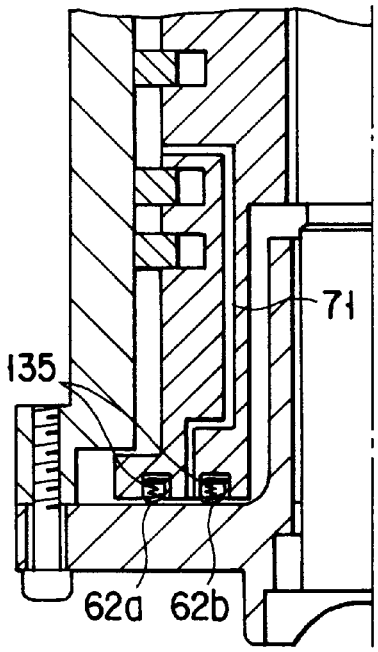
FIG. 43 is a longitudinal sectional view showing a modified example of the thirteenth embodiment.

In the constitution shown in FIG. 42, similar to the constitution shown in FIG. 20 (seventh embodiment), sub-seal rings 114 are provided in the first and second seal rings 62*a*, 62*b*, and a spring member 135 is fitted instead of sub-seal ring 114 in the constitution shown in FIG. 43.

(Fourteenth embodiment)

A fourteenth embodiment is described below while referring to FIG. 44 to FIG. 48.

This embodiment relates to enhancement of assembling performance of helical blade compressor having the features of the invention.

That is, in the assembling process of the compression mechanism 3, first, the seal ring 19 is fitted into the roller 14, and then inserted into the cylinder 12. In this embodiment, in order to insert smoothly, edges of the seal ring 19 or cylinder 12 are chamfered 141*a* to 141*d*.

Figure 44:
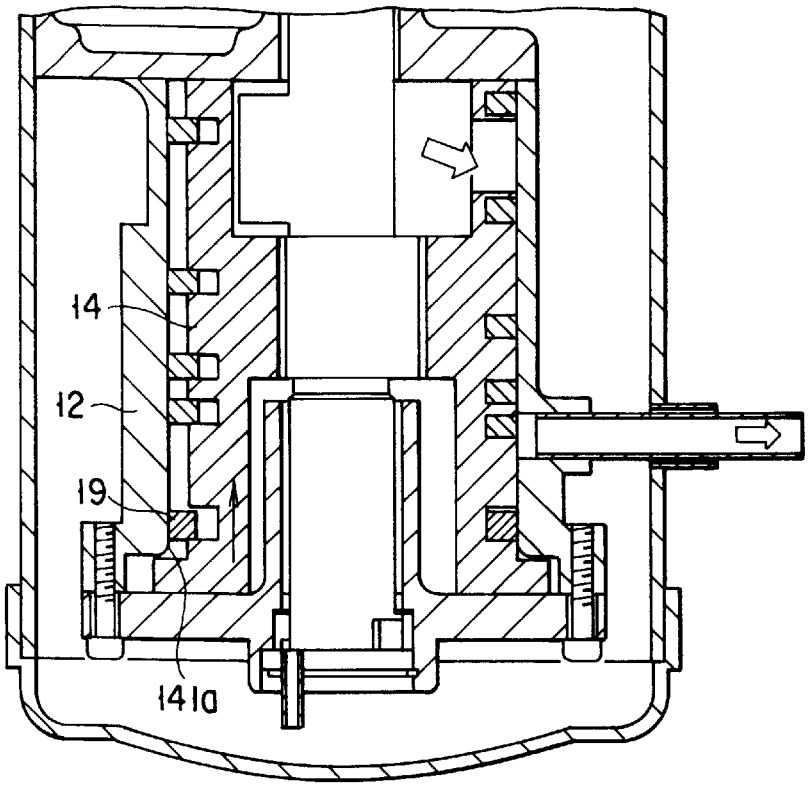
FIG. 44 is a longitudinal sectional view showing a fourteenth embodiment.
Figure 45:
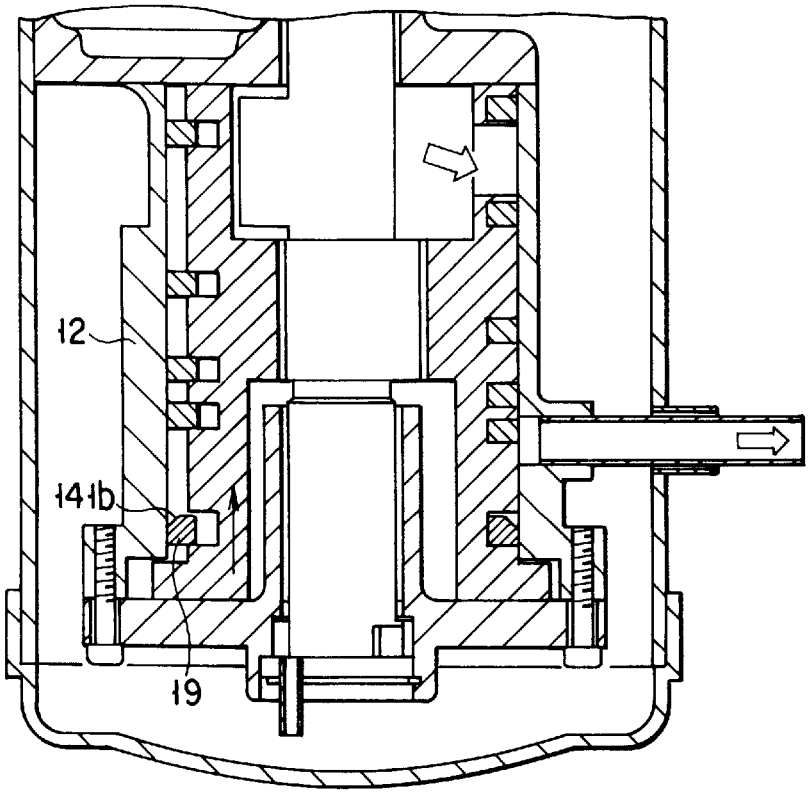
FIG. 45 is a longitudinal sectional view showing a modified example of the fourteenth embodiment.
Figure 46:
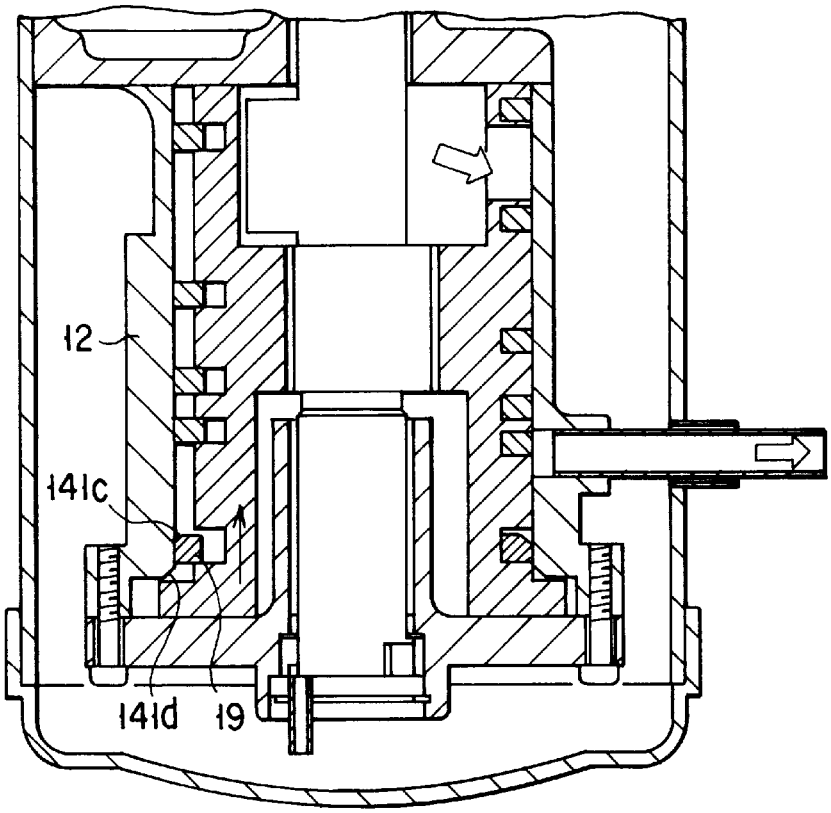
FIG. 46 is a longitudinal sectional view showing a modified example of the fourteenth embodiment.

In FIG. 44, the inner side edge of the cylinder 12 is chamfered 141*a*, in FIG. 45, the seal ring 19 side is chamfered 141*b*, and in FIG. 46, both the cylinder 12 side and seal ring 19 are chamfered 141*a*, 141*b*.

Figure 47:
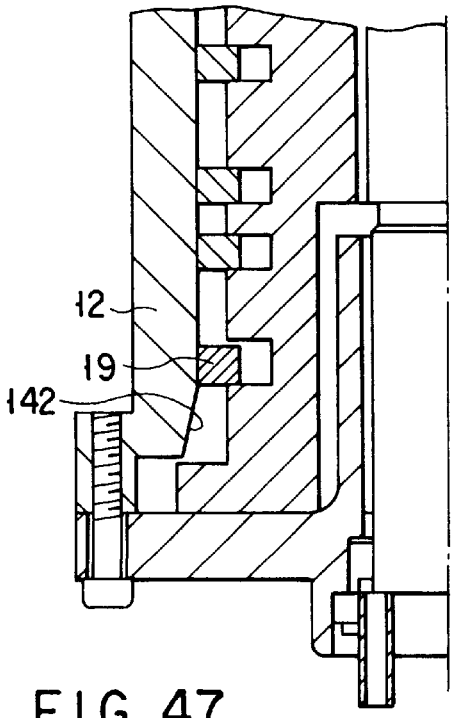
FIG. 47 is a longitudinal sectional view showing a modified example of the fourteenth embodiment.
Figure 48:
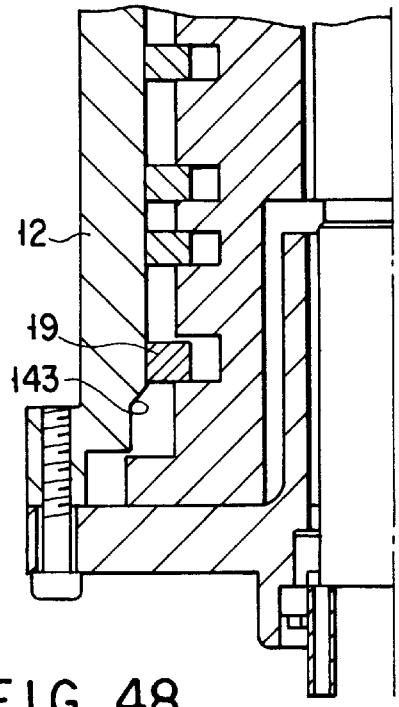
FIG. 48 is a longitudinal sectional view showing a modified example of the fourteenth embodiment.

Instead of chamfering, as shown in FIG. 47, tapering 142 may be also applied. Or, as shown in FIG. 48, a step 143 may be formed.

Figure 49A:
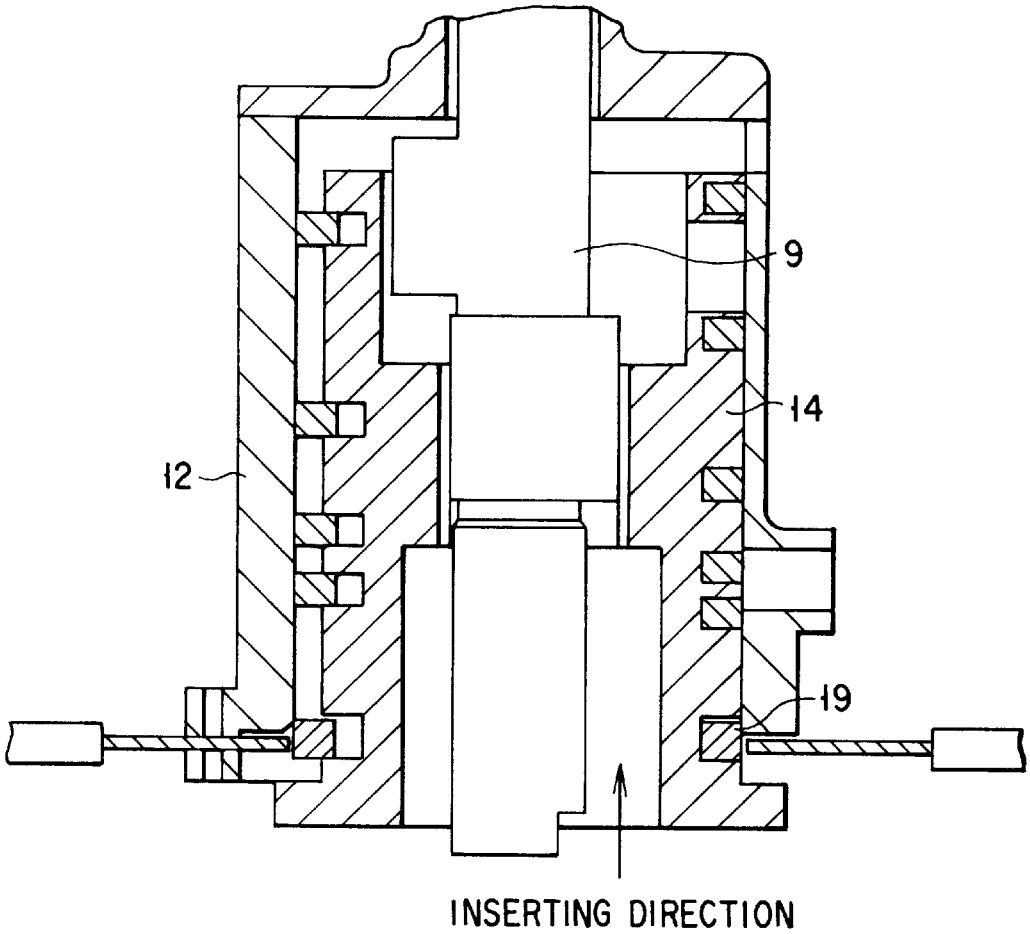
FIGS. 49A and 49B are longitudinal sectional view and plan view showing the assembling process of the compression mechanism for explaining the fourteenth embodiment.
Figure 49B:
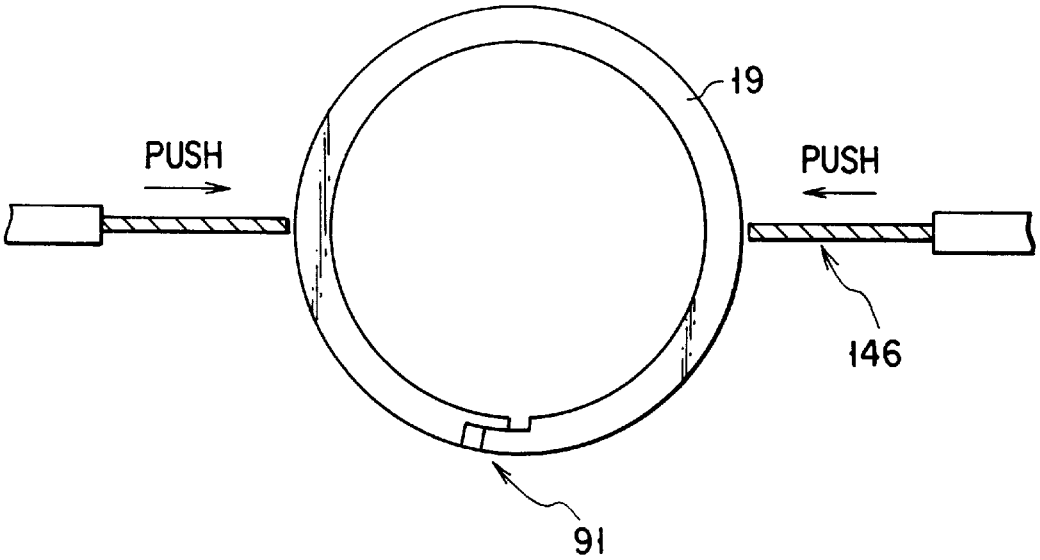

Using thus processed seal ring 19 or cylinder 12, the compression mechanism 3 may be assembled as shown in FIGS. 49A and 49B.

FIG. 49A shows a state immediately before insertion of seal ring 19 into the cylinder 12 together with the roller 14. As shown in FIG. 49B, the seal ring 19 has a junction 91, and the junction 91 can be dislocated in the peripheral direction in natural state.

Therefore, when inserting, the seal ring 19 is inserted into the cylinder 12 while contracting in diameter by pressing and compressing in the axial direction by means of several jigs 146.

At this time, if contraction of the seal ring 19 is not sufficient, it is properly guided by the action of the chamfered portion 141*b*, so that insertion error hardly occurs.

The jigs used for contracting the seal ring 19 may be replaced by 147 shown in FIGS. 50A and 50B. The jig 147 has a pair of pins 147*a*, 147*b* provided so as to be driven, and the pins 147*a*, 147*b* are engaged respectively with engagement holes 148*a*, 148*b* provided in the junction 91 of the seal ring 19, so that the junction 91 can be compressed.

(Fifteenth embodiment)

FIG. 51 is a diagram showing a structural example of a refrigeration cycle apparatus using the helical blade type compressor of the embodiment as the compressor.

In the refrigeration cycle apparatus of this embodiment, in particular, the working refrigerant is a refrigerant of higher condensation or evaporation pressure, such as HFC system refrigerant R32, R410A or R407C, than R22.

By using the refrigerant high in condensation or evaporation pressure, an absolute pressure difference between the high pressure side and low pressure side of the cycle is greater. In such condition, the sealing performance of high pressure and low pressure in the cylinder tends to be worse, and the thrust load acting on the roller increases.

However, according to the compressor of the invention, by the use of the seal ring 19 or 62, the sealing performance is enhanced, and the thrust load can be adjusted easily, and it is particularly effective when using such refrigerant.

In particular, R410A is higher than R22 in condensation pressure or evaporation pressure by about 1.5 times. The use of seal ring 19 or 62 in such condition is particularly effective means for enhancing the performance and reliability.

It must be noted, however, that the invention is not limited to the foregoing first to fifteenth embodiments alone, but may be modified in various forms within the spirit and range of the invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A helical blade type compressor comprising:

a case;

a cylinder provided in the case;

a roller disposed in the cylinder; and helical blades provided with uneven pitchers configured to provide a compression chamber having a volume made gradually smaller in an axial direction, said compression chamber being formed by said blades between said cylinder and said roller and being moved in a volume decreasing direction by relatively revolving said cylinder and said roller thereby compressing a gas in the compression chamber, wherein at least one seal member is provided in said roller, said seal member including a seal ring movably inserted into an annular groove provided in a periphery of the roller, said seal ring abutting against said annular groove and an inner periphery of the cylinder to separate pressure in the case and in the compression chamber.

2. A helical blade type compressor of claim 1, wherein said annular groove and the seal ring member to be inserted in the annular groove are provided in a plurality each.

3. A helical blade type compressor of claim 1, wherein said roller has a flange of a large diameter, and said seal ring is held by the flange.

4. A helical blade type compressor of claim 1, wherein said roller comprises a main body and a lid which can be divided in the portion of said annular groove.

5. A helical blade type compressor of claim 1, wherein the inside diameter of the cylinder inner circumference of the portion contacting with the seal ring member is different from the inside diameter of the portion in which said helical blade of the cylinder is disposed.

6. A helical blade type compressor of claim 1, wherein said annular ring and the seal ring member to be inserted in the annular ring are provided in a plurality each, and an intermediate pressure lead-in path for leading in a compression intermediate pressure from said compression chamber is provided in at least one position of the spaces divided by the plural seal ring members.

7. A helical blade type compressor of claim 1, wherein said seal member is freely inserted into an annular groove provided in the cylinder inner circumference, and abuts against the annular groove and roller to separate into the pressure in the case and the pressure in the compression chamber.

8. A helical blade type compressor of claim 7, wherein said cylinder is composed of at least two or more members that can be divided in the portion of said annular groove.

9. A helical blade type compressor of claim 7, wherein the annular groove in which said seal ring member is fitted is divided by a receiving member holding one end of said cylinder and the end of said roller, and said seal ring member abuts against said cylinder and the roller to separate into the pressure in the case and the pressure in the compression chamber.

10. A helical blade type compressor of claim 1, wherein said seal member is inserted into the annular groove provided at the end of said roller, and cooperates with a receiving member for holding the end of the roller to separate into the pressure in the case and the pressure in the compression chamber.

11. A helical blade type compressor of claim 1, wherein said seal member is inserted in the annular groove provided in a receiving member for holding the end face of said roller, and cooperates with the end face of the roller to separate into the pressure in the case and the pressure in the compression chamber.

12. A helical blade type compressor of claim 11, wherein an intermediate pressure lead-in path is provided for leading in a compression intermediate pressure into said seal member from said compression chamber.

13. A helical blade type compressor of claim 10, wherein said annular ring and the seal ring member to be inserted in the annular ring are provided in a plurality each, and an intermediate pressure lead-in path for leading in a compression intermediate pressure from said compression chamber is provided in at least one position of the spaces divided by the plural seal ring members.

14. A helical blade type compressor of claim 11, wherein an intermediate pressure lead-in path is provided for leading in a compression intermediate pressure into said seal member from said compression chamber.

15. A helical blade type compressor of claim 11, wherein said annular ring and the seal ring member to be inserted in the annular ring are provided in a plurality each, and an intermediate pressure lead-in path for leading in a compression intermediate pressure from said compression chamber is provided in at least one position of the spaces divided by the plural seal ring members.

16. A helical blade type compressor of claim 1, wherein said seal member comprises a first seal ring member and a second seal ring member, the first seal ring member is freely inserted into the annular groove provided in the roller outer circumference, and abuts against the annular groove and cylinder to separate into the high pressure side and low pressure side, and the second seal ring member is inserted in the annular groove provided at the end face of said roller, and cooperates with a receiving member for holding the end face of the roller to separate the high pressure and low pressure.

17. A helical blade type compressor of claim 1, wherein said seal member has a divided portion in one position along the circumferential direction, and is formed so as to be expanded in diameter.

18. A helical blade type compressor of claim 17, wherein at least one of said joint faces is always positioned in the groove for the ring, along with revolution of the roller, when the seal ring member projects to the maximum extent from the groove for holding the seal ring.

19. A helical blade type compressor of claim 1, wherein said seal member has a seal ring member and a spring member for thrusting the seal ring member in the outer circumferential direction.

20. A helical blade type compressor of claim 1, wherein said seal member is a seal ring member, and the seal ring member comprises a ring-shaped main body, a ring side annular groove provided on the outer circumference of the main body, and a sub-seal ring member fitted in the ring side annular groove.

21. A helical blade type compressor of claim 1, wherein said seal member is a seal ring member not having divided portion, and the seal ring member comprises a ring-shaped main body, a ring side annular groove provided on the inner circumference of the main body, and a sub-seal ring member fitted in the ring side annular groove.

22. A helical blade type compressor of claim 1, wherein said seal member is a seal ring member, and the seal ring member has a ring side annular groove opened at its outer circumferential side, and the section of the ring side annular groove is U-form or V-form, and the opening side is at high pressure.

23. A helical blade type compressor of claim 1, wherein said seal member is a seal ring member, and the seal ring member has a ring side annular groove opened at its inner circumferential side, and the section of the ring side annular groove is U-form or V-form, and the opening side is at low pressure.

24. A helical blade type compressor of claim 1, wherein said seal member is a seal ring member having an outer circumference, an inner circumference, and a plane enclosing them, and said plane is composed so that the area sliding with the member contacting with the seal ring is smaller than the area not sliding.

25. A helical blade type compressor of claim 11, wherein the seal member inserted in the annular groove at the end face of said roller is a seal ring member having seal member side annular grooves at the outer circumference and inner circumference, sub-seal ring members are inserted in these seal member side annular grooves, and it also has an intermediate pressure lead-in path for leading the compression intermediate pressure in the compression chamber to the opposite side of the sliding side of the seal ring.

26. A helical blade type compressor of claim 25, wherein a spring member is provided at an opposite side of the sliding surface of said seal ring.

27. A helical blade type compressor of claim 1, wherein the material of the seal member is engineering plastic (resin).

28. A helical blade type compressor of claim 1, wherein said seal member is a seal ring member, and the inner end portion of the seal ring member to be inserted into the cylinder is chamfered.

29. A helical blade type compressor of claim 1, wherein said seal member is a seal ring member, and the outer end portion of the seal ring member to be inserted into the cylinder is chamfered.

30. A refrigeration cycle apparatus using the helical blade type compressor of claim 1, wherein the refrigerant used in the refrigeration cycle is a refrigerant higher in condensation or evaporation pressure than R22.

31. The helical blade compressor of claim 1, wherein said gas is a refrigerant gas used in a refrigeration cycle.

* * * * *